US005501395A

United States Patent [19]

McElroy

[11] Patent Number: 5,501,395

[45] Date of Patent: Mar. 26, 1996

[54] STACKABLE BOX WITH REINFORCED WALLS

[75] Inventor: Peter M. McElroy, Auckland, New Zealand

[73] Assignee: Kiwi Packaging Limited, Auckland, New Zealand

[21] Appl. No.: 301,726

[22] Filed: Sep. 7, 1994

Related U.S. Application Data

[63] Continuation of Ser. No. 971,606, Nov. 6, 1992, abandoned.

[30] Foreign Application Priority Data

Nov. 7, 1991 [NZ] New Zealand ..... 240500
Apr. 10, 1992 [NZ] New Zealand ..... 242313

[51] Int. Cl.[6] ..... B65D 5/20

[52] U.S. Cl. ..... 229/148; 229/919

[58] Field of Search ..... 229/DIG. 11, DIG. 5, 229/915, 919, 148, 190

[56] References Cited

U.S. PATENT DOCUMENTS

| | | | |
|---|---|---|---|
| 2,163,117 | 6/1939 | Evans et al. | 229/919 X |
| 3,012,703 | 12/1961 | Gander | 229/919 X |
| 3,820,706 | 6/1974 | Gibson et al. | 206/509 |
| 3,883,067 | 5/1975 | McGlynn et al. | 229/919 X |
| 3,940,053 | 2/1976 | Putman et al. . | |
| 4,056,223 | 11/1977 | Williams | 229/190 X |
| 4,304,353 | 12/1981 | Stollberg | 229/DIG. 11 |
| 4,389,013 | 6/1983 | Hall et al. | 229/915 X |
| 4,537,344 | 8/1985 | Thomas | 229/915 X |
| 4,567,996 | 2/1986 | Muise | 206/509 X |
| 4,770,339 | 9/1988 | Weimer | 229/DIG. 11 |
| 4,860,948 | 8/1989 | Hofstede | 229/918 X |
| 4,911,355 | 3/1990 | Bannister | 229/DIG. 11 |
| 4,953,782 | 9/1990 | Noland | 229/DIG. 5 |
| 5,002,224 | 3/1991 | Muise | 229/DIG. 11 |
| 5,125,568 | 6/1992 | Bauer | 229/919 X |
| 5,203,494 | 4/1993 | Blomfield | 229/919 X |

FOREIGN PATENT DOCUMENTS

| | | |
|---|---|---|
| 1401484 | 5/1965 | France . |
| 2120655 | 8/1972 | France . |
| 2447861 | 8/1980 | France . |
| 4000229 | 7/1991 | Germany . |

*Primary Examiner*—Allan N. Shoap
*Assistant Examiner*—Christopher J. McDonald
*Attorney, Agent, or Firm*—Nikaido, Marmelstein, Murray & Oram

[57] ABSTRACT

A corrugated board package formed from a blank of a kind having a single component to define a base, sides and top. The blank has a substantially square or rectangular base portion limited by fold lines and/or cuts or cutouts and four separate peripheral portions. The peripheral portions include an opposed pair of the peripheral portions being foldable to create first opposed side walls and subsequent to assembly being further folded to provide at least part of the top of the package, those portions of the peripheral portion to form the opposed side walls being extended at one end in a direction parallel to the fold line and/or cut or cutout connection to the base portion to define a flap which, either in a folded or unfolded condition, can be folded at right angles from the side wall to assume a position as part of the structure of an end wall normal to each opposed side wall with a projection or projections formed by part of the flap, whether a fold created periphery or otherwise, directed upwardly. The peripheral portions also include a second opposed pair of peripheral portions each being foldable to create part of the structure of the end wall normal to the first mentioned opposed side walls. The construction and arrangement of the package is such that in the assembled package the parallel flutes of the corrugated board run across the blank so as to be vertically extending in each side wall and in at least that part of each flap having the projection and further being such that there are openings formed in the base portion to allow the same to nest reproducibly on the projections of a like package, whether closed or not, to provide a nesting capability. The invention also consists of a blank for the package, the method of forming the package and apparatus for forming the package by the method using a sequence of forming zones.

19 Claims, 24 Drawing Sheets

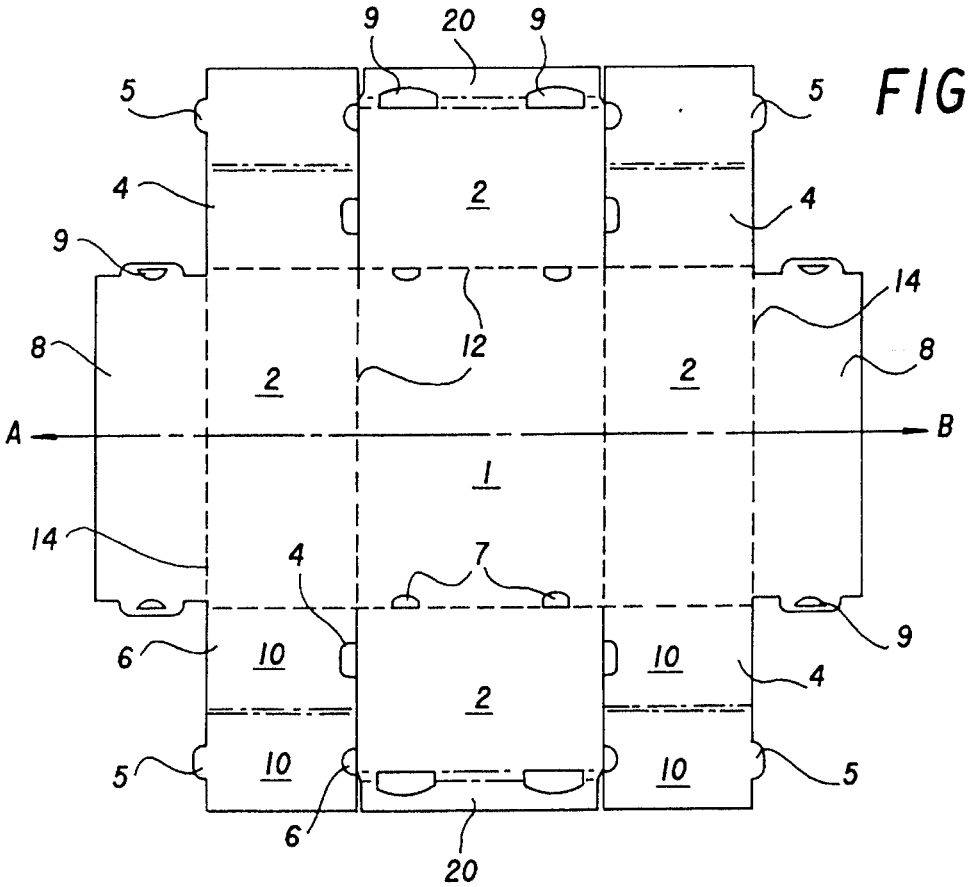
FIG.2
FIG.3
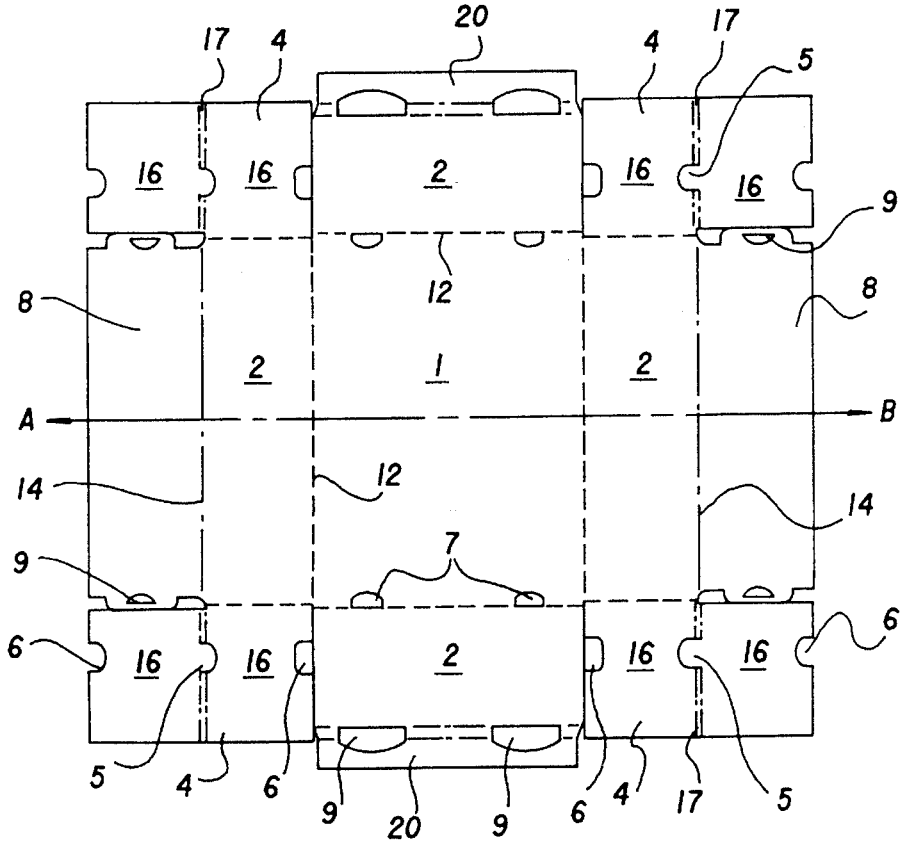

STACKABLE BOX WITH REINFORCED WALLS

This application is a continuation of application Ser. No. 07/971,606 filed Nov. 6, 1992.

BACKGROUND OF THE INVENTION

1. Field of the Invention

This invention, relates to packaging, blanks therefor, methods of manufacture of such blanks and/or packaging, the use thereof and apparatus for manufacturing such packaging and in particular, to packaging suitable for holding fruit for example.

The present invention relates to a form of package capable of being nested without damage to its contents. This is particular the case where a bruiseable commodity such a kiwifruit must be carried therein.

2. Description of the Prior Art

US Patent Specification No. 4,134,533, the full content of which is hereincluded by way of reference, discloses a single component blank for a carton, the resultant carton and methods of forming of the carton. The carton of U.S. Pat. No. 4,134,533 has the ability to provide a square or a rectangular base section with side and end walls formed therefrom, each end wall also including a top or part thereof for at least partially closing the carton. In such a system, the end walls are formed from end sections of the blank (inwardly of the comers thereof) so as to ensure that the flutes in the end walls run substantially vertical, when assembled, and the indexing projections at a foldline in the end section is supported by vertically extending flutes. Such a construction, however, while being wasteful of cardboard, also requires extensions of the end wall defining sections to be provided which will reinforce the horizontally extending flutes within the side wall section.

The present invention relates to an alternative one component cannon construction which enables a more economic usage of corrugated cardboard.

BRIEF SUMMARY OF THE INVENTION

Accordingly, in one aspect the invention consists in a blank for a cannon or package (hereinafter "package") comprising:

a substantially square or rectangular base portion limited by fold lines and/or cuts or cutouts; and four separate peripheral portions:

(i) an opposed pair of the peripheral portions being foldable to create first opposed side walls (hereinafter "side walls") and subsequent to assembly being further folded to provide at least part of the top of the package, those portions of the peripheral portion(s) to form the opposed side walls being extended at one end in a direction parallel to the fold line (and/or cut or cutout) connection to the base portion to define a flap which, either in a folded or unfolded condition, can be folded at right angles from the side wall to assume a position as part of the structure of a wall (hereafter "end wall") normal to each opposed side wall with a projection or projections formed by part of the flap (whether a fold created periphery or otherwise) directed upwardly; and (ii) a second opposed pair of peripheral portions each being foldable to create part of the structure of a the end wall normal to the first mentioned opposed side walls;

the construction and arrangement being such that the parallel flutes of the corrugated board run across the blank so as to be vertically extending in each side wall and in at least that part of each flap having a projection when the blank is assembled and further being such that there are openings formed in the base portion to allow the same to nest reproducibly on the projections of a like package (whether closed or not) to provide a nesting capability.

Preferably, the second pair of peripheral portions are each capable of being folded up to define a portion of an end wall and then be folded over an aforementioned flap with any projection thereof protruding through an opening therein.

Preferably the base portion is rectangular and the foldline of each side wall is a longer periphery of the base portion.

Preferably each flap is to be folded about a foldline including a cut or cutout within the flap to define a projection.

Preferably each end wall, when assembled, includes at least two projections each defined in one thickness of the corrugated board from a double layer of the board, each projection being defined from a different flap of different side walls.

Preferably, when assembled a flap defining a projection does not overlie another flap defining a projection of the same end wall.

In a second aspect, the invention consists in a package formed from a blank comprising:

a substantially square or rectangular base portion limited by fold lines and/or cuts or cutouts; and four separate peripheral portions:

(i) an opposed pair of the peripheral portions being foldable to create first opposed side walls (hereafter "side walls") and subsequent to assembly being further folded to provide at least part of the top of the package, those portions of the peripheral portion to form the opposed side walls being extended at one end in a direction parallel to the fold line (and/or cut or cutout) connection to the base portion to define a flap which, either in a folded or unfolded condition, can be folded at right angles from the side wall to assume a position as part of the structure of a wall (hereafter "end wall") normal to each opposed side wall with a projection or projections formed by part of the flap (whether a fold created periphery or otherwise) directed upwardly; and (ii) a second opposed pair of peripheral portions each being foldable to create part of the structure of an end wall normal to the first mentioned opposed side walls;

the construction and arrangement being such that in the assembled package the parallel flutes of the corrugated board run across the blank so as to be vertically extending in each side wall and in at least that part of each flap having a projection and further being such that there are openings formed in the base portion to allow the same to nest reproducibly on the projections of a like package (whether closed or not) to provide a nesting capability.

Preferably the second pair of peripheral portions have each been folded up to define a portion of an end wall and then have been folded over an aforementioned flap with any projection thereof protruding through an opening therein.

Preferably the base portion is rectangular and the foldline of each side wall is a longer periphery of the base portion.

Preferably each flap has been folded about a foldline including a cut or cutout within the flap to define a projection.

Preferably each end wall in the package includes at least two projections each defined in one thickness of the corrugated board from a double layer of the board, each projection being defined from a different said flap of different side walls.

Preferably a flap defining a projection does not overlie another flap defining a projection of the same end wall.

Preferably the flaps are adhered to the second peripheral portions.

Preferably the tops locate with an aperture(s) on the projections(s).

In a further aspect, the invention consists in apparatus for forming a carton or package (hereafter "package") from a blank comprising:

a substantially square or rectangular base portion limited by fold lines and/or cuts or cutouts; and four separate peripheral portions:

(i) an opposed pair of the peripheral portions being foldable to create first opposed side walls (hereafter "side walls") and subsequent to assembly being further folded to provide at least part of the top of the package, those portions of the peripheral portion to form the opposed side walls being extended at one end in a direction parallel to the fold line (and/or cut or cutout) connection to the base portion to define a flap which, either in a folded or unfolded condition, can be folded at right angles from the side wall to assume a position as part of the structure of a wall (hereafter "end wall") normal to each opposed side wall with a projection or projections formed by pan of the flap (whether a fold created periphery or otherwise) directed upwardly; and (ii) a second opposed pair of peripheral portions each being foldable to create part of the structure of an end wall normal to the first mentioned opposed side walls;

the construction and arrangement being such that the parallel flutes of the corrugated board run across the blank so as to be vertically extending in each side wall and in at least that part of each flap having a projection when the blank is assembled and further being such that there are openings formed in the base portion to allow the same to nest reproducibly on the projections of a like package (whether closed or not) to provide a nesting capability;

said apparatus comprising:

magazine device to receive a supply of the blanks and for serially advancing one blank at a time to an end forming zone;

end forming device defining an end forming zone to receive a blank from the magazine device in a predetermined orientation of the base portion and its attendant portions and to apply adhesive thereto and to fold the projection defining flaps;

side wall forming device defining a side wall forming zone to receive the partially folded blank from the end forming device with the base portion in substantially the same orientation and to position the first opposed pair of peripheral portions to define side walls and to position the projection defining flaps thereof within the plane of the end walls; and end wall completing device defining an end wall completing zone to receive the partially folded blank from the side wall defining zone without substantial reorientation of the base portion to fold the second opposed pair of peripheral portions to adhere with the end wall plane included projection defining flaps; and, optionally top closing device defining a top closing zone to receive the almost complete package without substantial reorientation of said base portion to close the top forming portion of the first opposed pair of peripheral portions.

Preferably the second pair of peripheral portions are each capable of being folded up to define a portion of an end wall and then be folded over an aforementioned flap with any projection thereof protruding through an opening therein, and the end wall completing devices folds the second opposed pair of peripheral portions to adhere as an overlay over the flaps.

Preferably the base portion is rectangular and the foldline of each side wall is a longer periphery of the base portion.

Preferably each the flap is folded about a foldline including a cut or cutout within the flap to define a the projection.

Preferably each end wall, when assembled, includes at least two projections each defined in one thickness of the corrugated board from a double layer of the board, each projection being defined from a different flap of different side walls.

Preferably, when assembled a flap defining a projection does not overlie another flap defining a projection of the same end wall.

Preferably there is included the top closing device defining a top closing zone.

Preferably the apparatus is adapted to use a mandrel dropped down into the blank to provide the upfolds of the end wall and/or side wall portions.

Preferably the apparatus has a package forming sequence of approximately 8 seconds from start to finish.

Preferably there is no central former, instead there being in use a sequential presentation of the blank as it is being formed to different operational zones.

In a further aspect, the invention consists in a method of forming a carton or package (hereinafter "package") from a blank comprising:

a substantially square or rectangular base portion limited by fold lines and/or cuts or cutouts; and four separate peripheral portions:

(i) an opposed pair of the peripheral portions being foldable to create first opposed side walls (hereafter "side walls") and subsequent to assembly being further folded to provide at least part of the top of the package, those portions of the peripheral portion to form the opposed side walls being extended at one end in a direction parallel to the fold line (and/or cut or cutout) connection to the base portion to define a flap which, either in a folded or unfolded condition, can be folded at right angles from the side wall to assume a position as part of the structure of a wall (hereafter "end wall") normal to each opposed side wall with a projection or projections formed by part of said flap (whether a fold created periphery or otherwise) directed upwardly; and (ii) a second opposed pair of peripheral portions each being foldable to create part of the structure of an end wall normal to the first mentioned opposed side walls;

the construction and arrangement being such that the parallel flutes of the corrugated board run across the blank so as to be vertically extending in each side wall and in at least that part of each flap having a projection when the blank is assembled and further being such that there are openings formed in the base portion to allow the same to nest reproducibly on the projections of a like package (whether closed or not) to provide a nesting capability;

the method comprising:

(A) (i) receiving a blank from a magazine supply thereof in a serial manner in a particular orientation of the base portion thereof and its attendant portions and without any substantial reorientation of that base portion sequentially;

(B) (i) applying adhesive to the blank and folding the projection defining flaps of the first opposed pair of peripheral portions;

(ii) positioning the first opposed pair of peripheral portions to define the side walls and to position the projection defining flaps thereof (that have previously been folded, if necessary, to reveal the projection) within the plane of the end walls;

(iii) folding the second opposed pair of peripheral portions to adhere with the end wall included plane projection defining flaps; and, optionally (iv) closing the top forming portions of the first opposed pair of peripheral portions over the top of the side walls and end walls to close the package.

Preferably the second pair of peripheral portions are each folded up to define a portion of an end wall and then folded over an aforementioned flap with any projection thereof protruding through an opening therein.

Preferably the base portion is rectangular and the foldline of each side wall is a longer periphery of the base portion.

Preferably each the flap is folded about a foldline including a cut or cutout within the flap to define a the projection.

Preferably each end wall, when assembled, includes at least two projections each defined in one thickness of the corrugated board from a double layer of the board, each projection being defined from a different flap of different side walls.

Preferably, where performed without the use of a central former, ie. there is sequential presentation to different operational zones.

The invention consists in the foregoing and also envisages constructions of which the following gives examples.

BRIEF DESCRIPTION OF THE DRAWINGS

The preferred form of the invention shall now be described with reference to the accompanying drawings in which:

FIG. 2 is a plan view of a corrugated board blank suitable for use in forming the package shown in FIG. 1;

FIG. 3 is a plan view of a second alternative corrugated board blank suitable for use in forming a package according to an alternative preferred form of the invention;

FIG. 4 shows the blank having adhesive applied or as adhesive is being applied the projection defining flaps of the first opposed pair of peripheral portions being folded over so as to present the projection defined by a cut spaced from the fold line thereof, such a process being that referred to as Stage 1 in FIG. 8 referred to hereafter, FIG. 5 shows the Stage 2 referred to in FIG. 8 hereof where the first opposed pair of peripheral portions are positioned to define the side walls and to position the projection defining flaps thereof (that have previously been folded to reveal the projection — FIG. 4) within the plane of the end walls;

FIG. 6 is the Stage 3 referred to FIG. 8 hereafter where the second opposed pair of peripheral portions are folded to adhere as an overlay over the end wall plane included projection defining flaps;

FIG. 7 is the optional but preferred Stage 4 referred to in FIG. 8 hereof where the top forming portions of the first opposed pair of peripheral portions are closed over the top of the side walls and end walls to close the package;

FIGS. 9 to 13 show an embodiment of the apparatus for manufacturing packaging as per the invention;

FIG. 9 is a full side elevation of the apparatus showing the four stages of manufacture as well as the operation start and operation stop positions, the locations of various manufacturing operations is shown, the position of four sectional views is also illustrated;

FIG. 10*a* shows the operation start or Stage 1 as well as the location of sectional view 1, the flat blank magazine is shown and also the blank selector and blank removal device as well as actuators for these;

FIG. 10*b* shows Stage 2 of the operation and also the location of sectional view No. 2, this figure shows the glue applicator as well as actuators involved with edge prefolding and strengthening;

FIG. 10*c* shows an elevation of Stage 3 of the operation and also the location of sectional view 3, the figure also illustrates the actuators involved with side folding and the construction of the box itself;

FIG. 10*d* illustrates the final or Stage 4 of the operation and the location of sectional view 4, the actuators involved with the closure of the box lid and box stacking are also illustrated as well as the finished box magazine;

FIG. 11*a* is a sectional view through Stage 1 of the operation;

FIG. 11*b* is a sectional view through Stage 2 of the operation;

FIG. 11*c* is sectional view 3 through Stage 3 of the operation;

FIG. 11*d* is sectional view 4 through Stage 4 of the operation;

Figure 12:
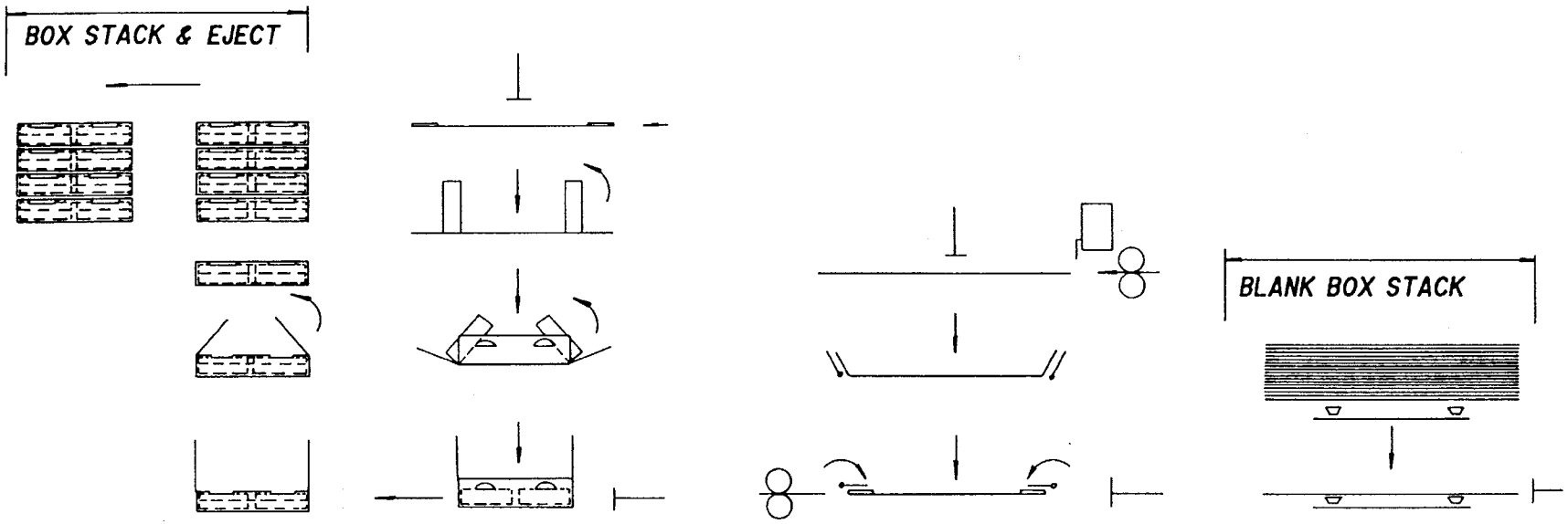
Figure 13A:
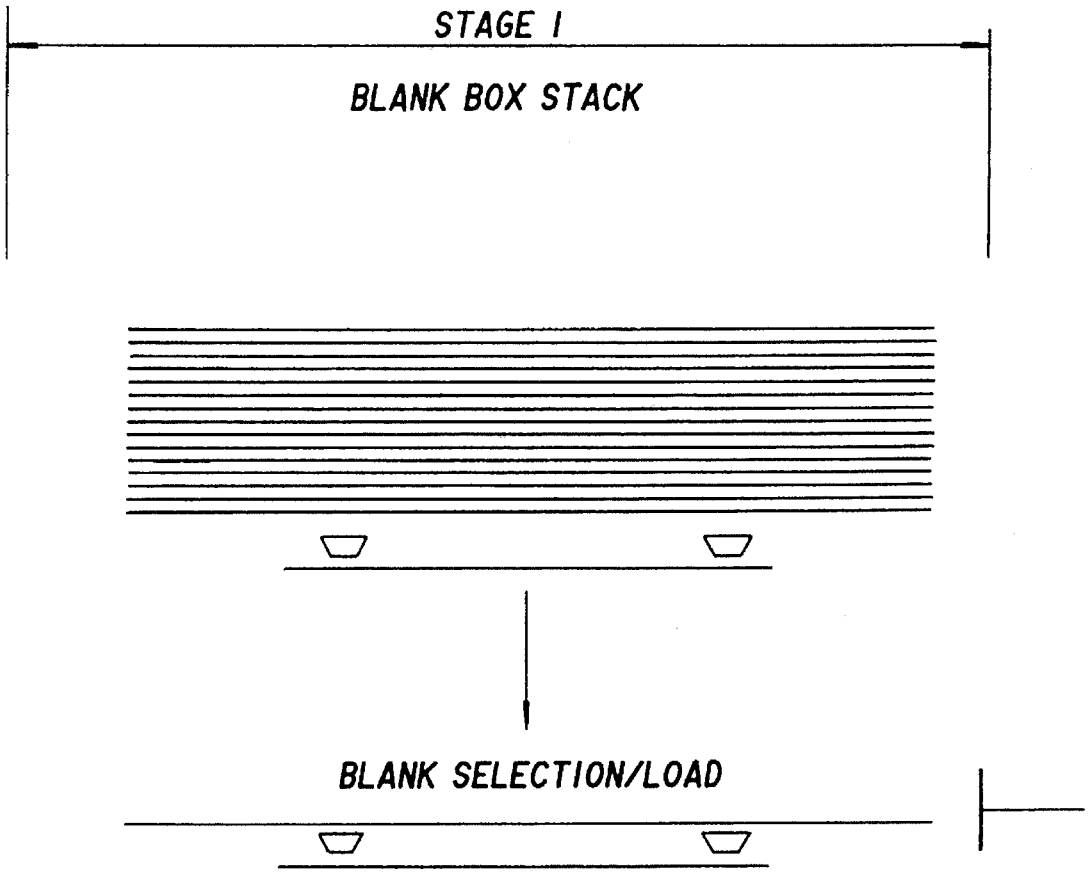
Figure 13B:
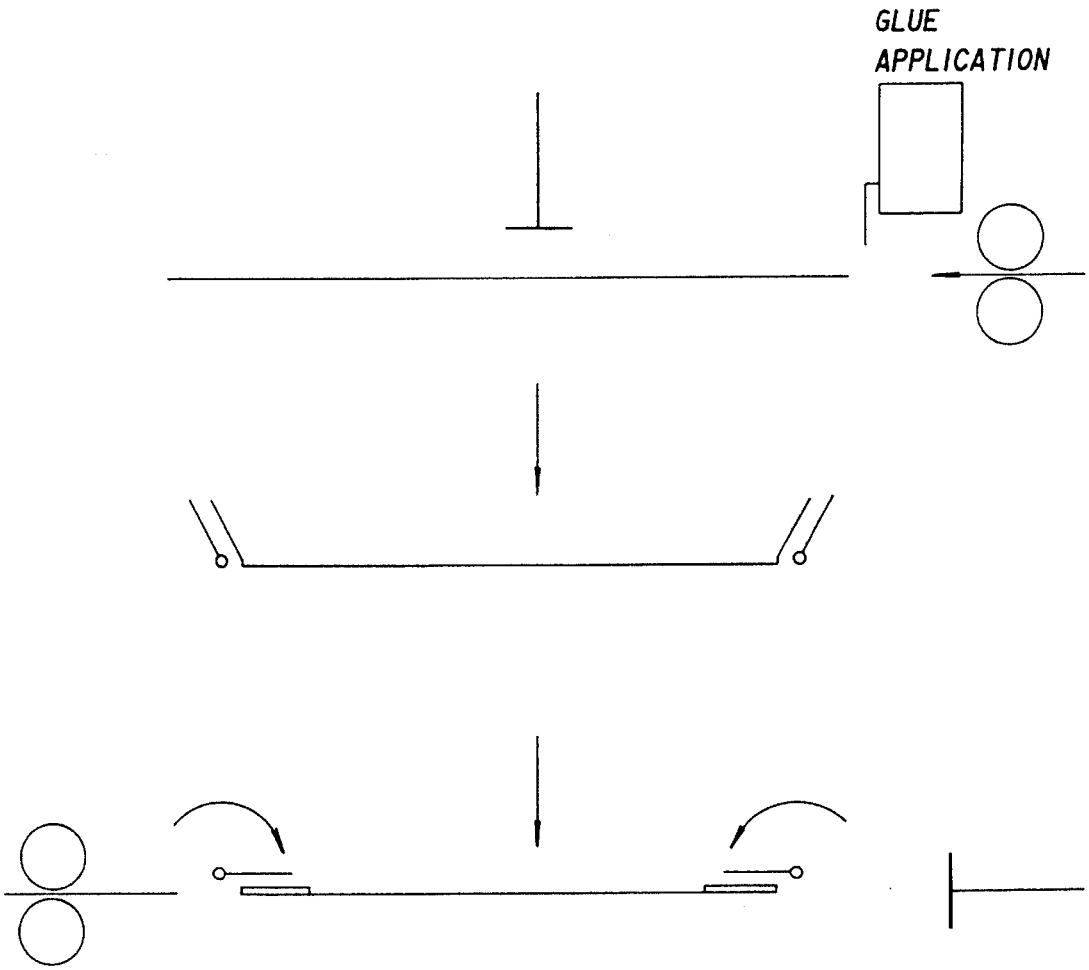
Figure 13C:
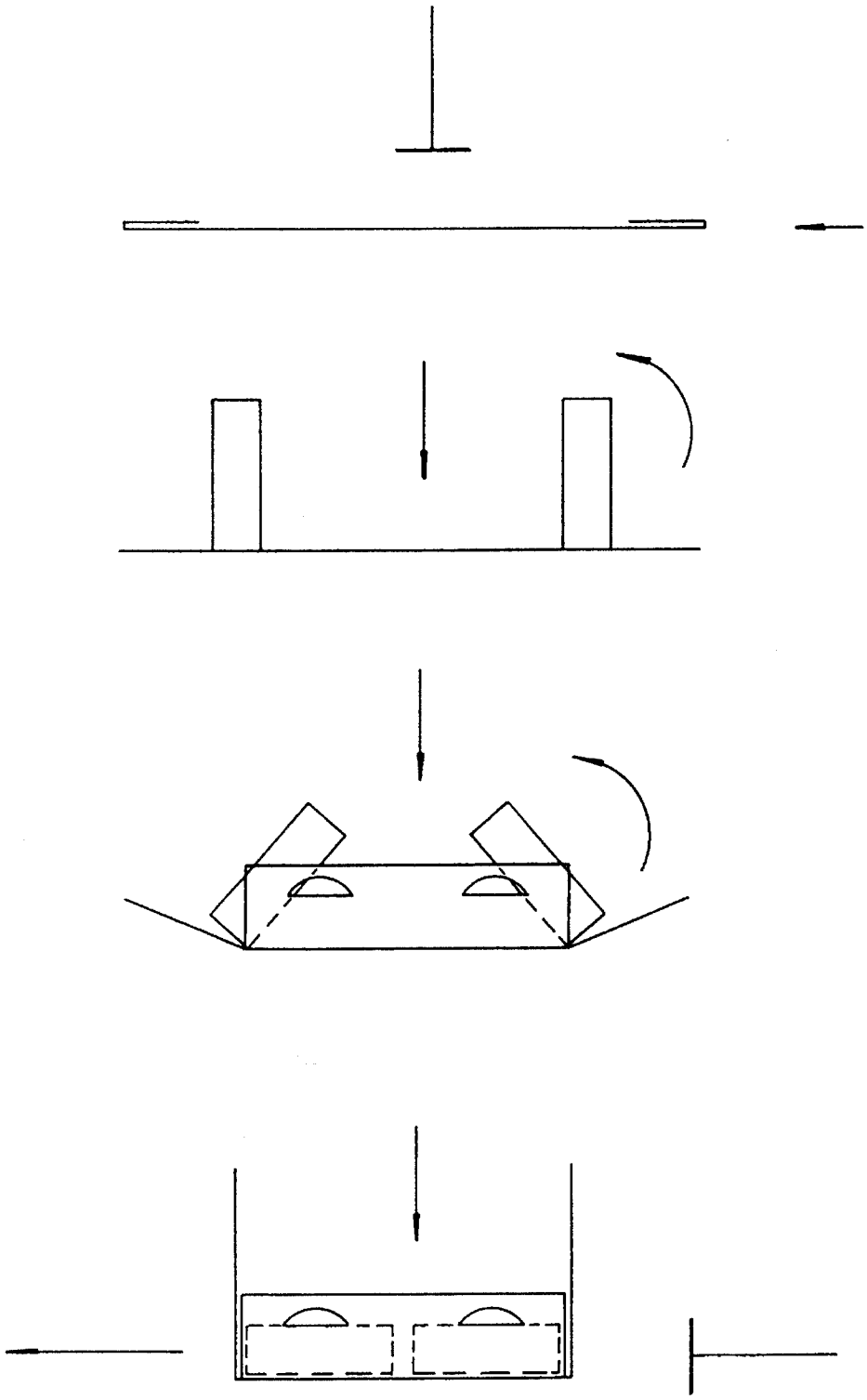
Figure 13D:
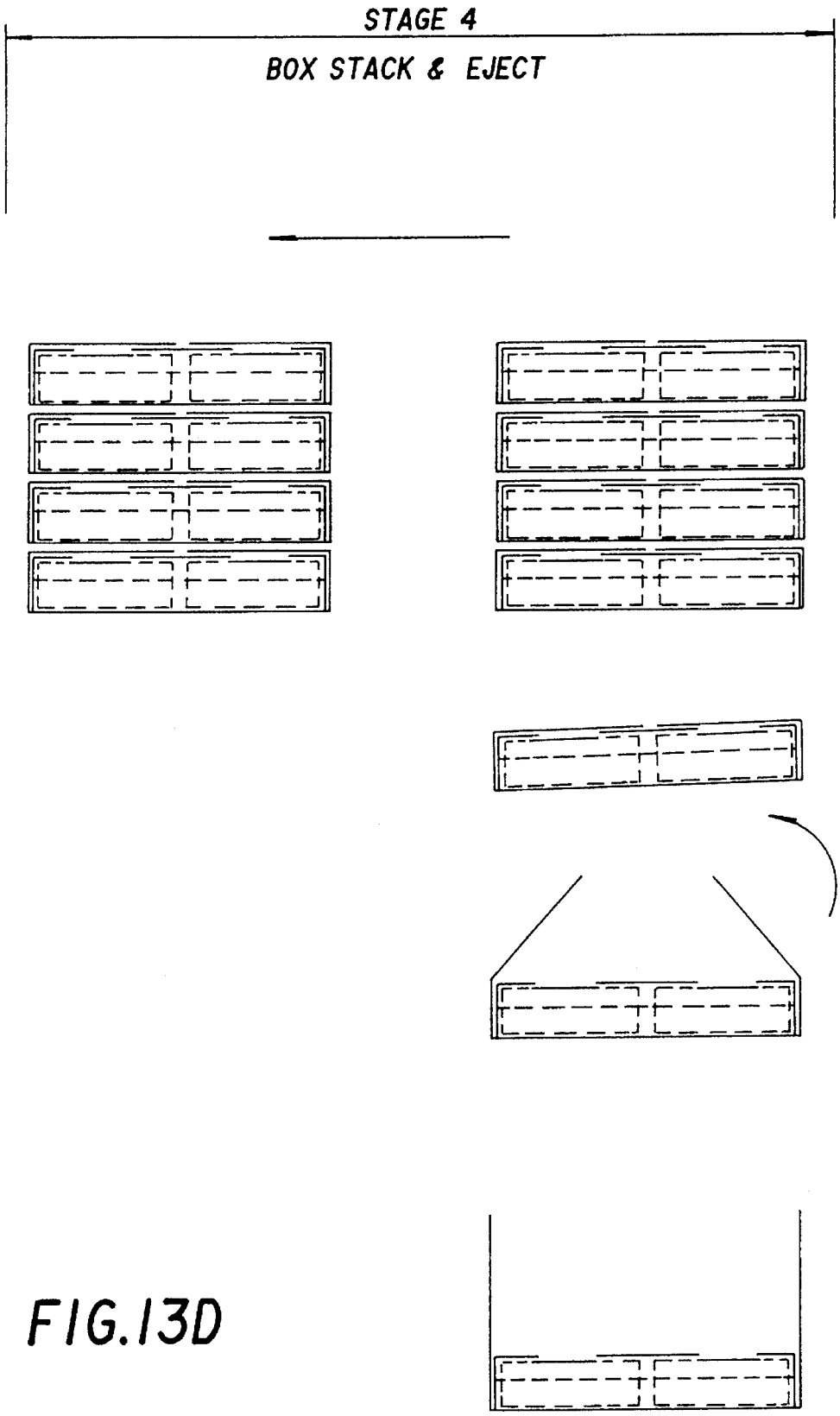
Figure 14:
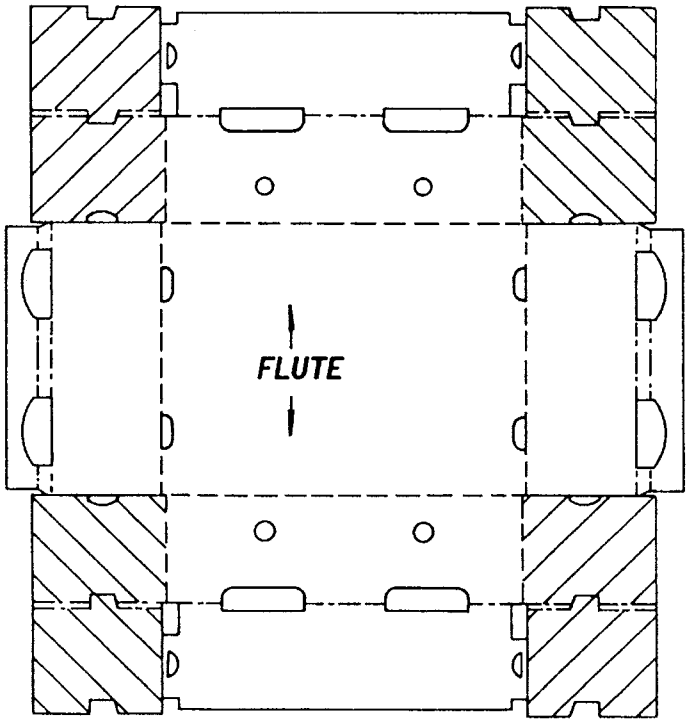
Figure 15:
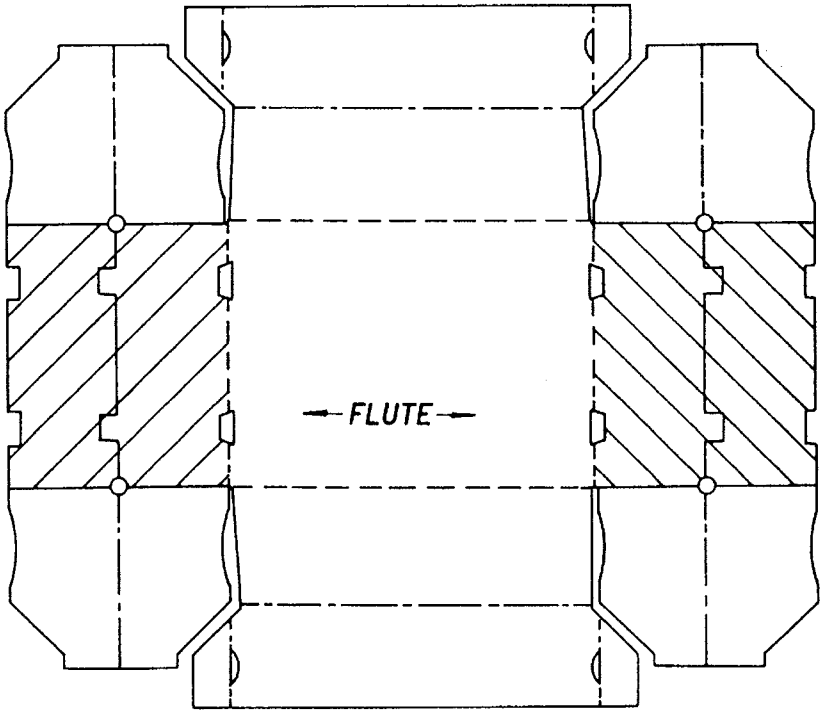
Figure 16:
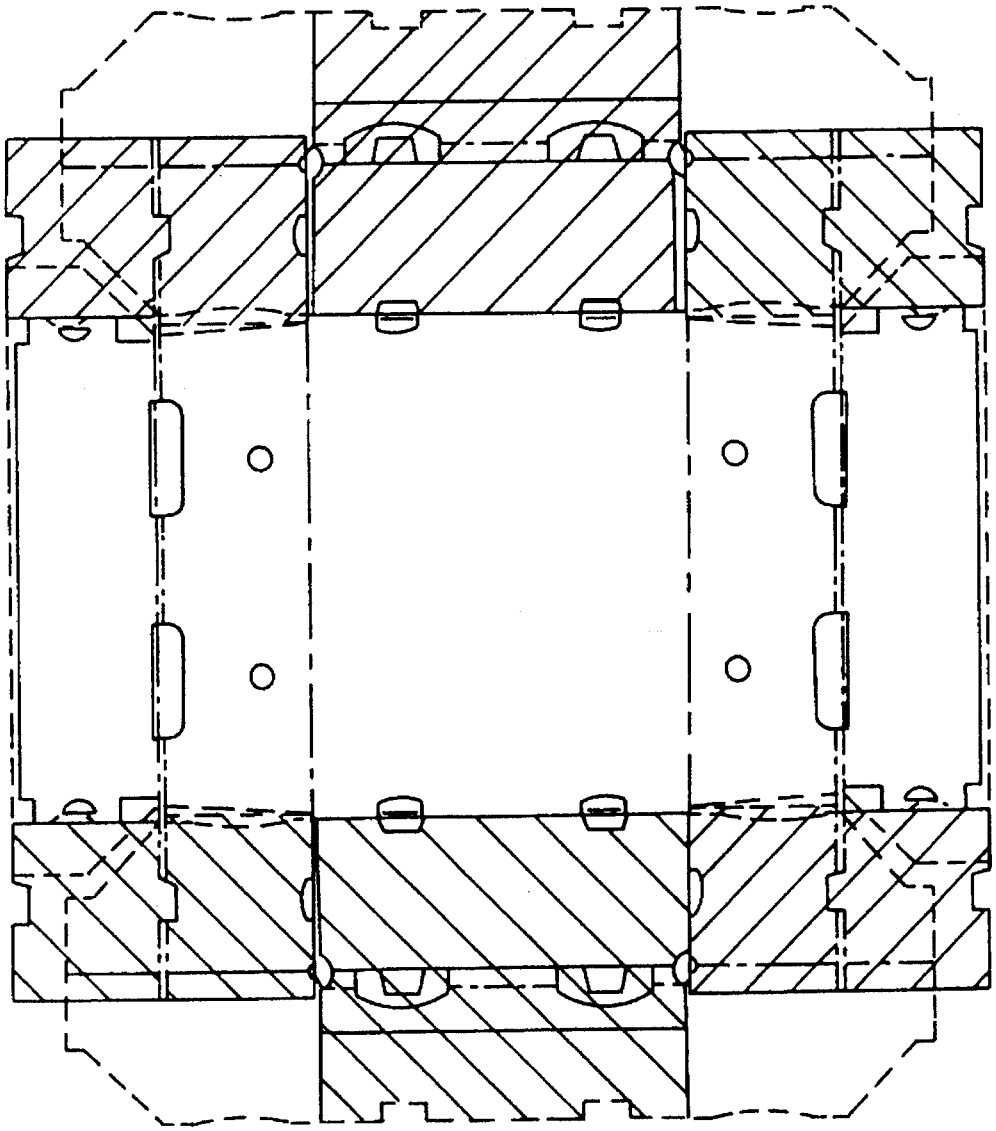
Figure 17:
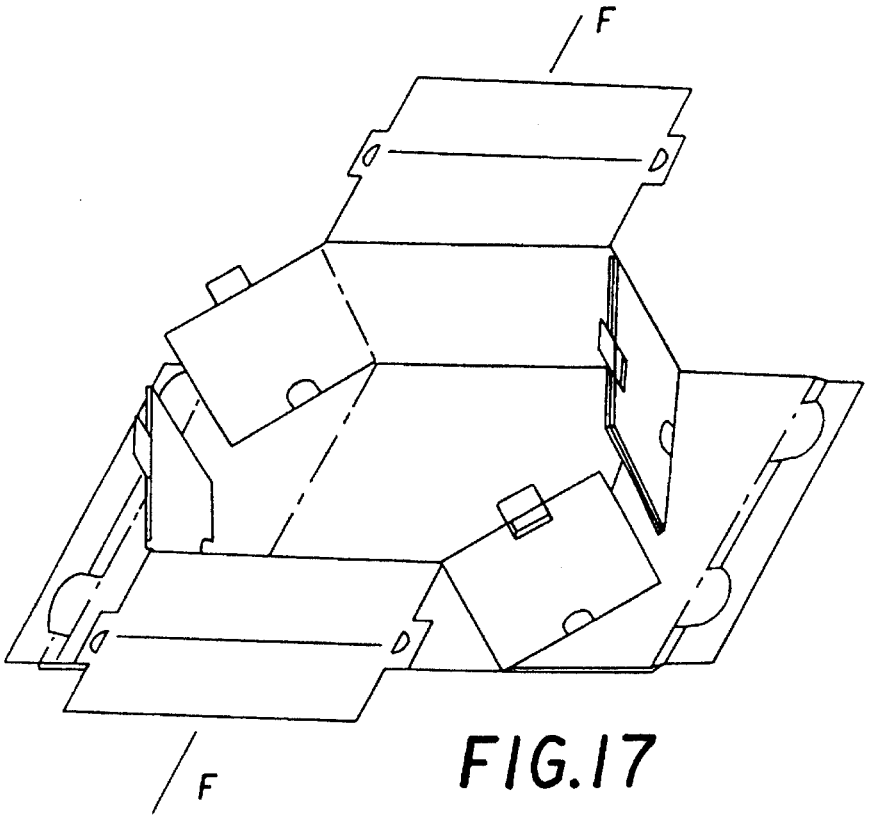
Figure 18:
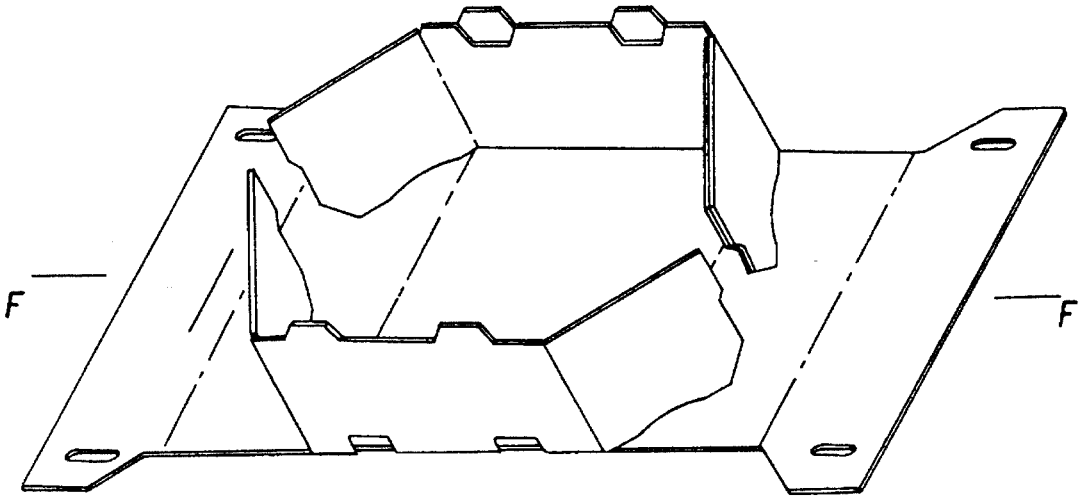

FIGS. views 12 and 13 are descriptive illustrations of the forming process;

FIG. 12 shows the operations occurring at all four stages of the forming process;

FIG. 13*a* shows the operations occurring at Stage 1 of the forming process;

FIG. 13*b* shows operations occurring at Stage 2 of the forming process;

FIG. 13*c* shows operations occurring at Stage 3 of the forming process;

FIG. 13*d* shows the operations occurring at Stage 4 of manufacture;

FIG. 14 is a blank of the present invention where the flute direction of the corrugations of the corrugated board (preferably the corrugations being sandwiched) extend transversely off the page in the arrowed direction entitled FLUTE, the cross-hatching showing those corner or substantially corner placed regions of the flaps that extend from the side wall defining region to provide the end wall included reinforcement members with the vertically extending corrugations, the projection of each flap being from one of the two layers of corrugated board to be placed inwardly substantially within the plane of the end wall;

FIG. 15 is a similar layout to that of FIG. 14 but this time showing the form of the blank as disclosed in U.S. Pat. No. 4,134,533, this time the cross-hatch regions showing the end sections from which the projection defining flaps with the vertically extending corrugations is derived, the flute direct again being indicated by the arrowed direction labelled FLUTE, it being seen that the cross-hatching is inward of the corners;

FIG. 16 is an overlying of FIG. 14 on a dotted outline of FIG. 15 showing that for the same base region more corrugated board material is required for the type of construction as depicted in U.S. Pat. No. 4,134,533;

FIG. 17 shows with the flute direction F—F the partial erection of a package or carton in accordance with the present invention using a blank as shown in FIG. 14; and FIG. 18 is the similar stage of erection to that of FIG. 17 but of a blank form of U.S. Pat. No. 4,134,533 as is depicted in FIG. 15, the flute direction of the corrugations of the single component blank being shown again by the arrowed F—F.

DETAILED DESCRIPTION OF THE INVENTION

The invention relates to a package which is suitable for holding fruit such as kiwifruit for example. The package is of a type such that a mechanically stable stack of packages can be formed.

The package is formed from a blank of a suitable sheet material Preferably a paper board such as corrugated board). Desirably, the corrugated board has a twin or multi-ply medium. For example, the corrugated board can be formed by the process outlined in New Zealand patent specification 231961.

Figure 1:
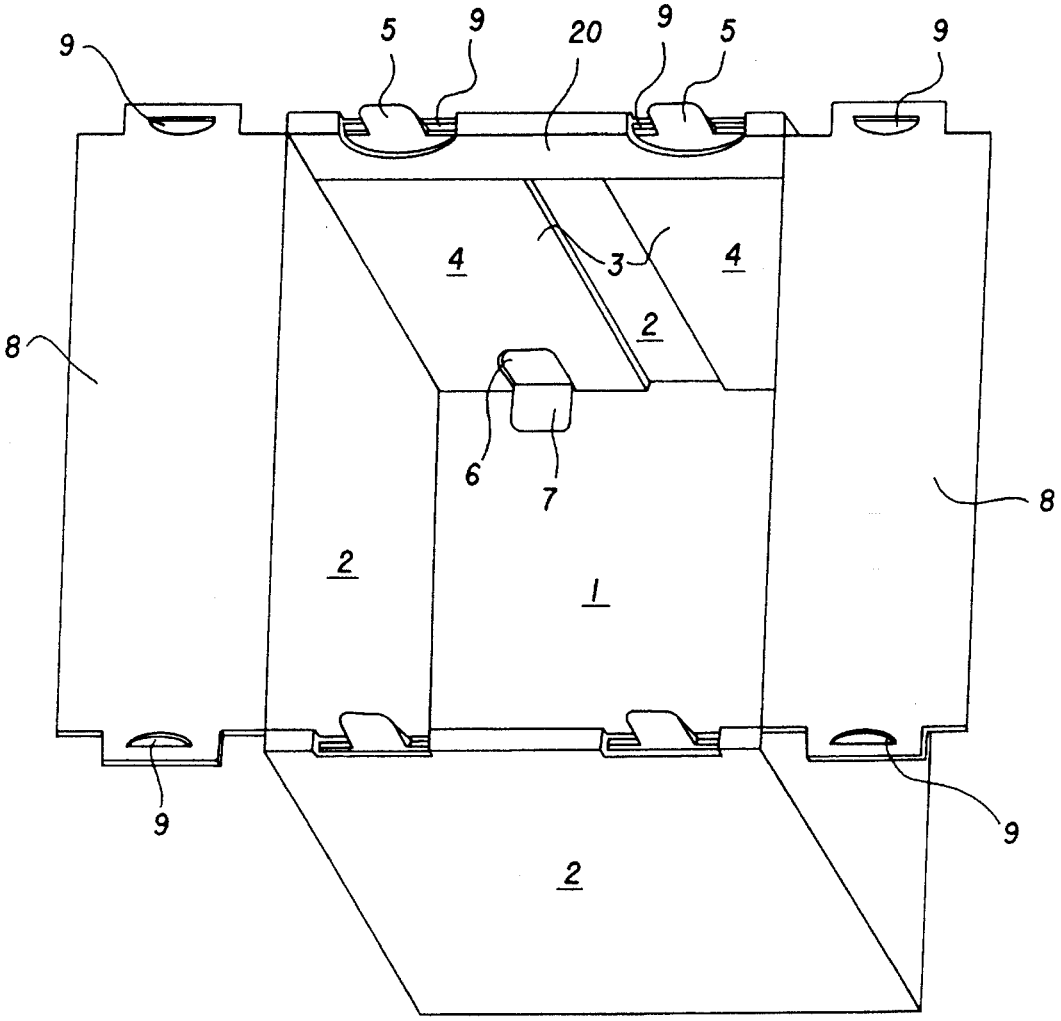
FIG. 1 is a perspective view of an assembled package according to one preferred form of the invention.
Figure 4:
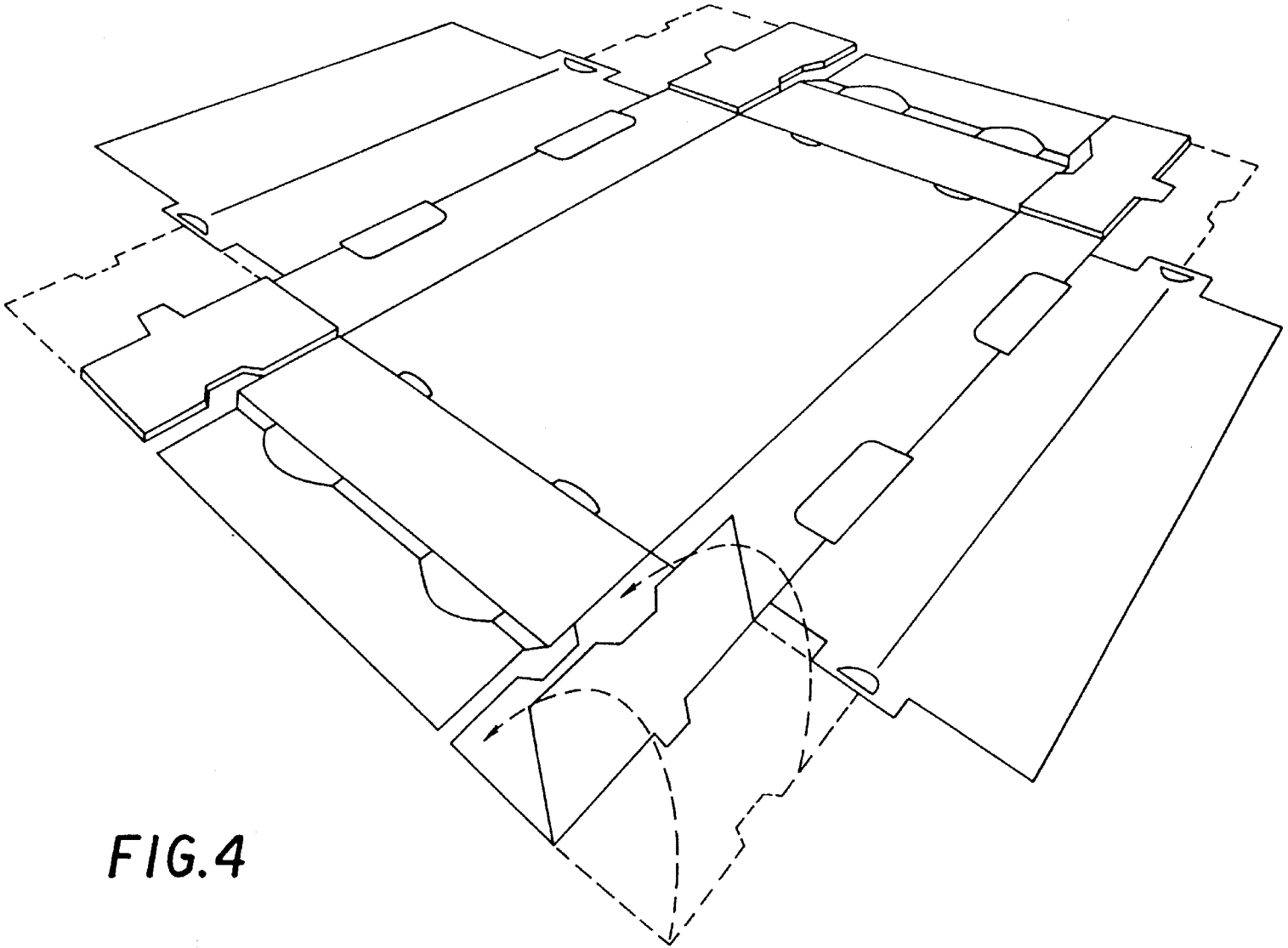
FIGS. 4 to 7 show a third alternative preferred package partly or completely assembled.
Figure 5:
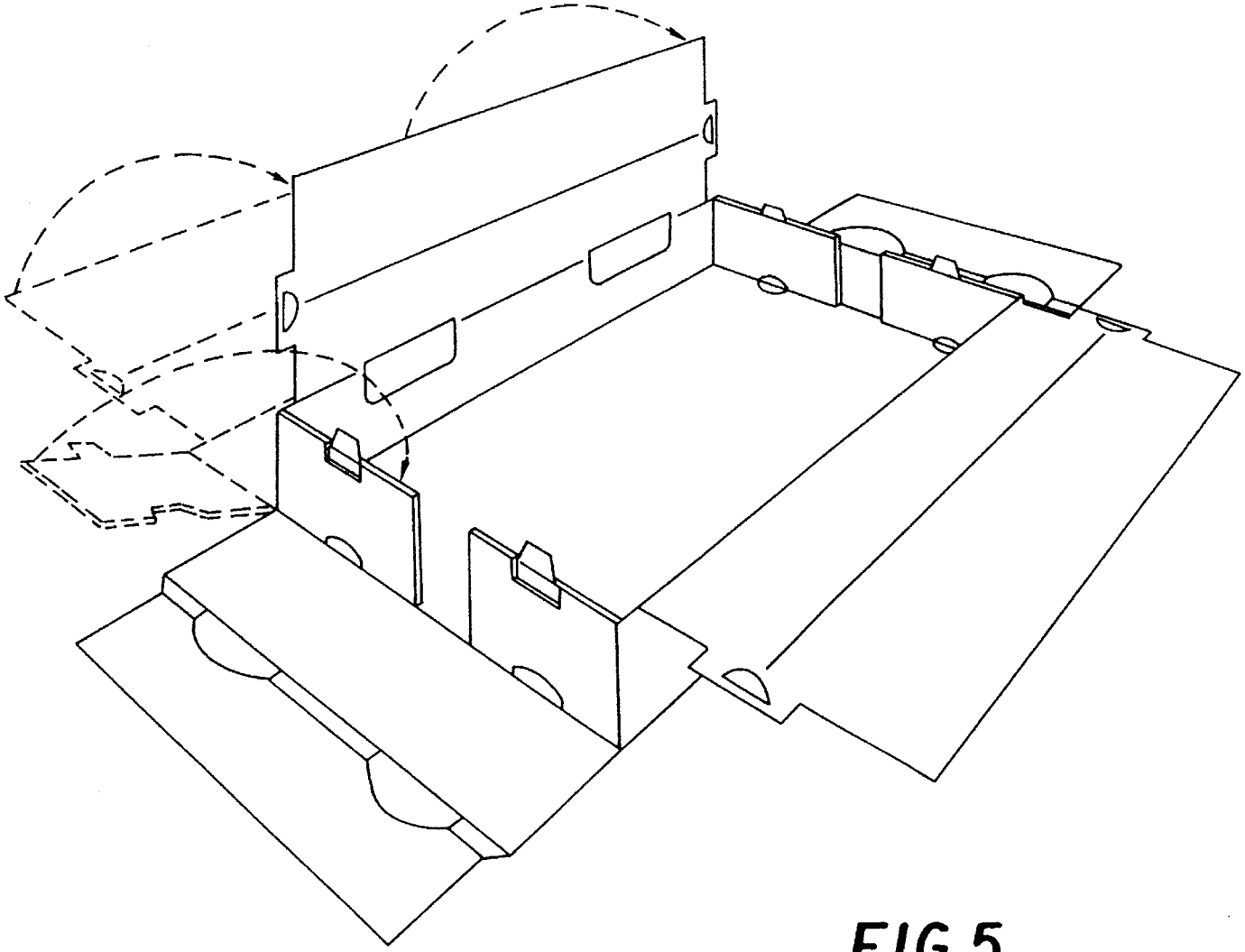
Figure 6:
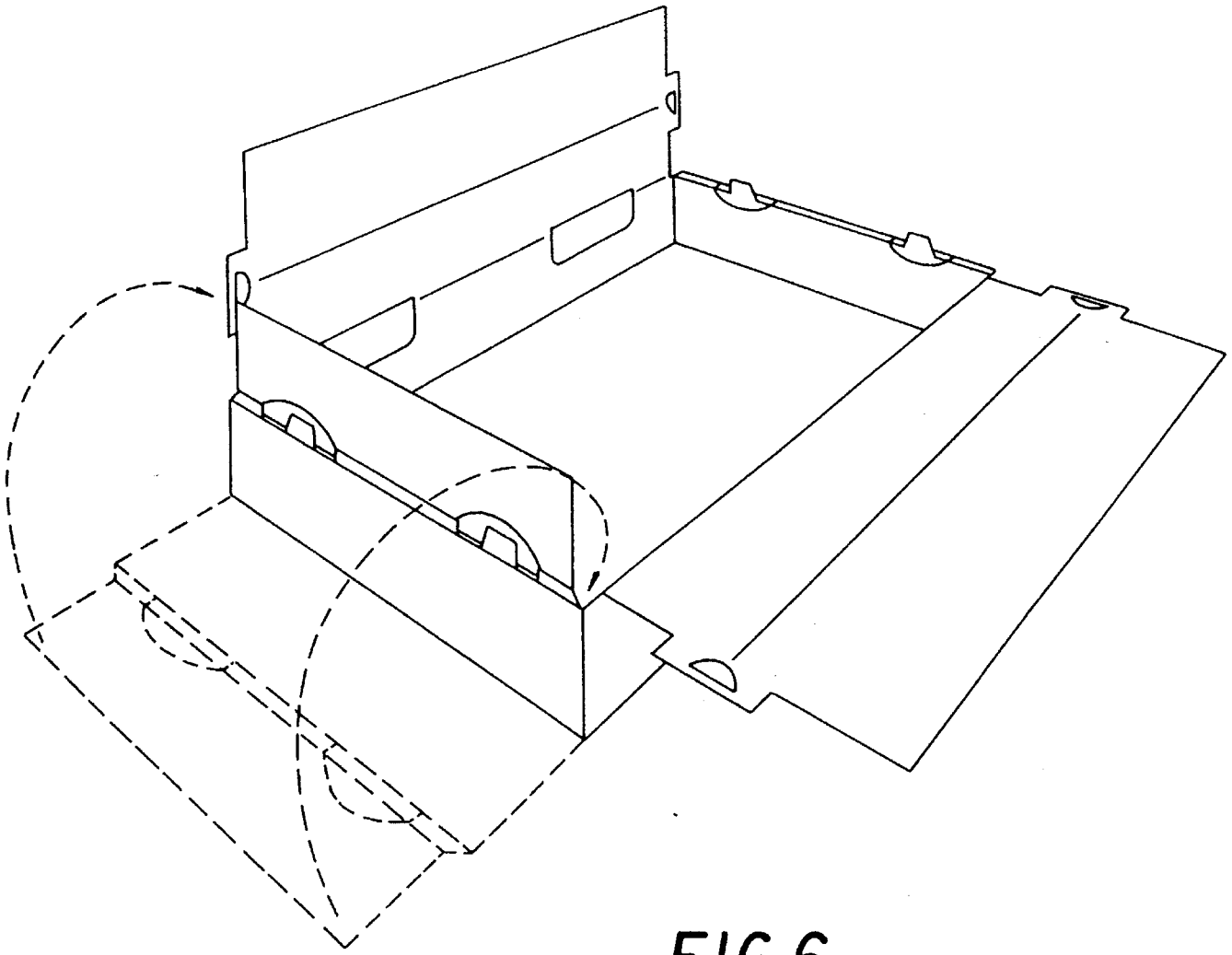
Figure 7:
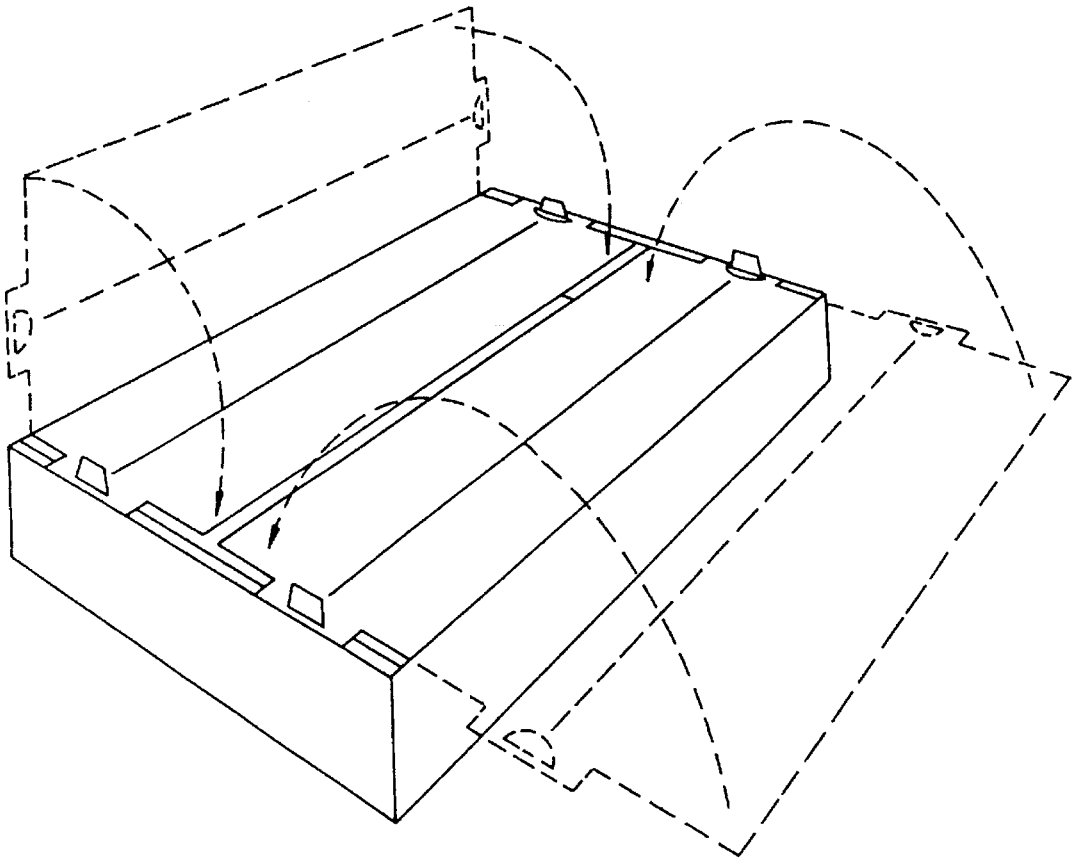
Figure 8:
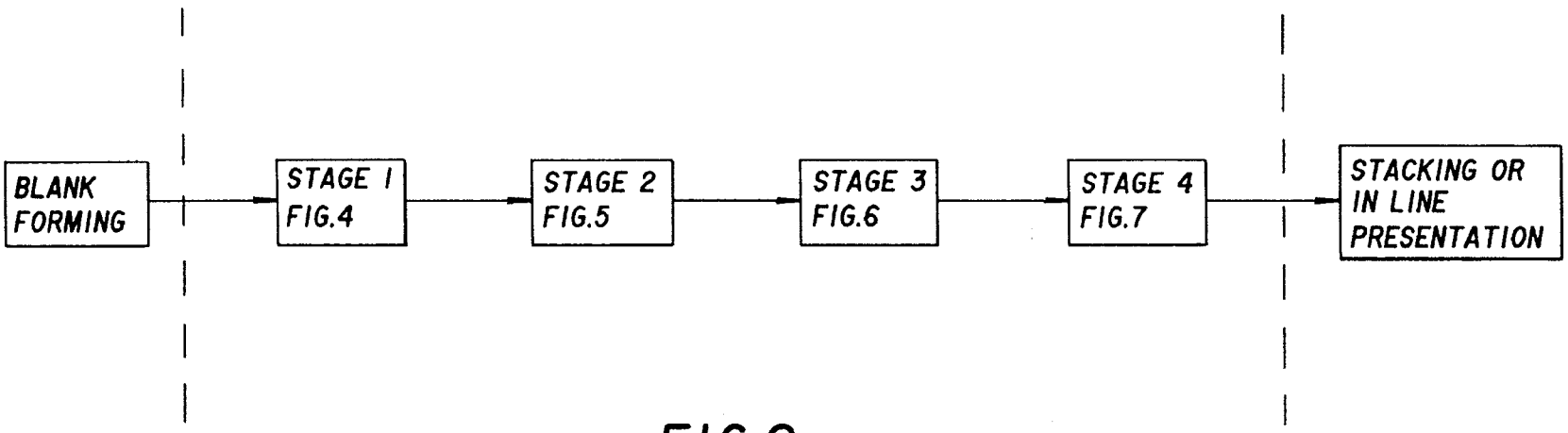
FIG. 8 is a flow diagram showing the sequence of operations to be performed namely Stage 1 through Stage 4 in apparatus in accordance with the present invention, the blank forming stage preferably preceding Stage 1 and stacking or in line presentation preferably following the conclusion of the apparatus controlled processing steps.
Figure 9:
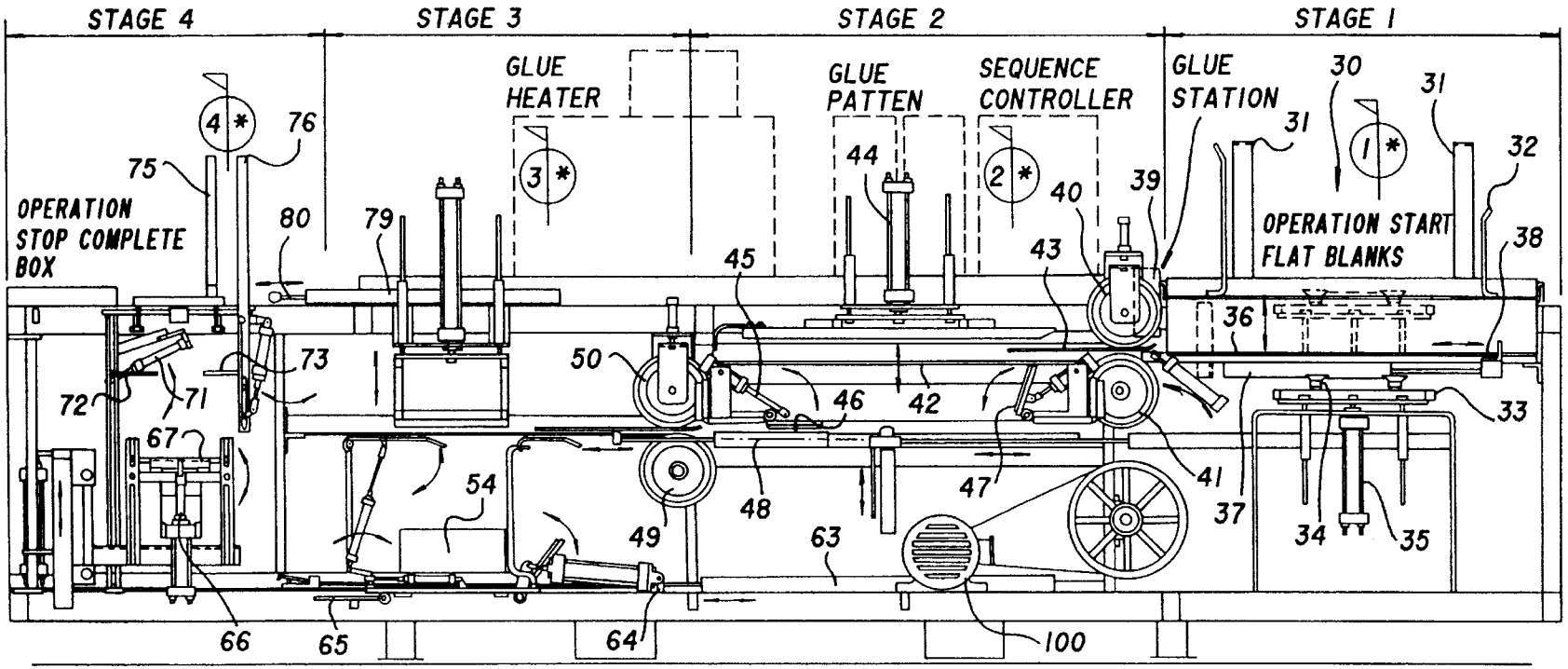
Figure 10A:
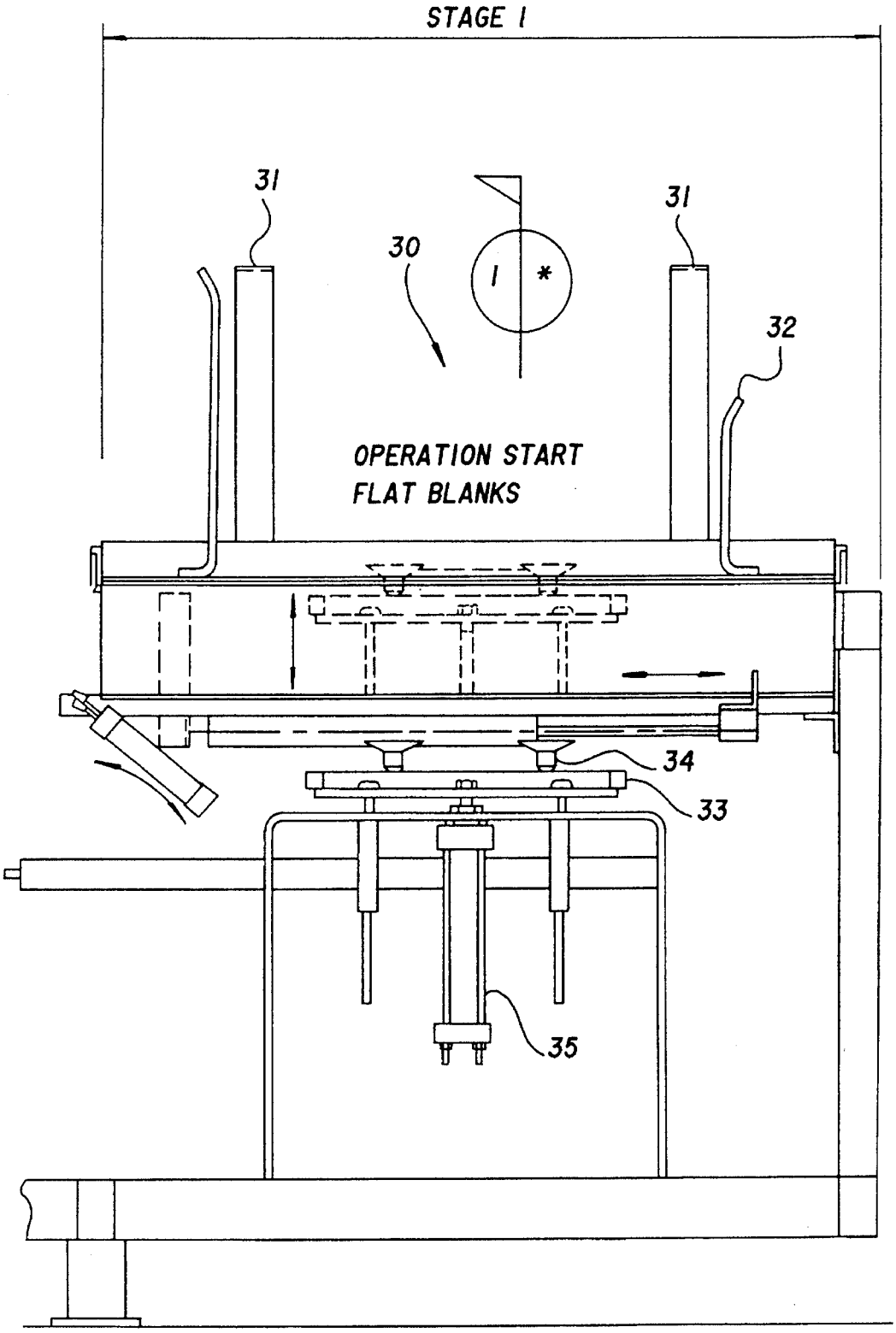
FIGS. 10*a* to 10*d* show the apparatus illustrated in FIG. 9 in an enlarged view.
Figure 10B:
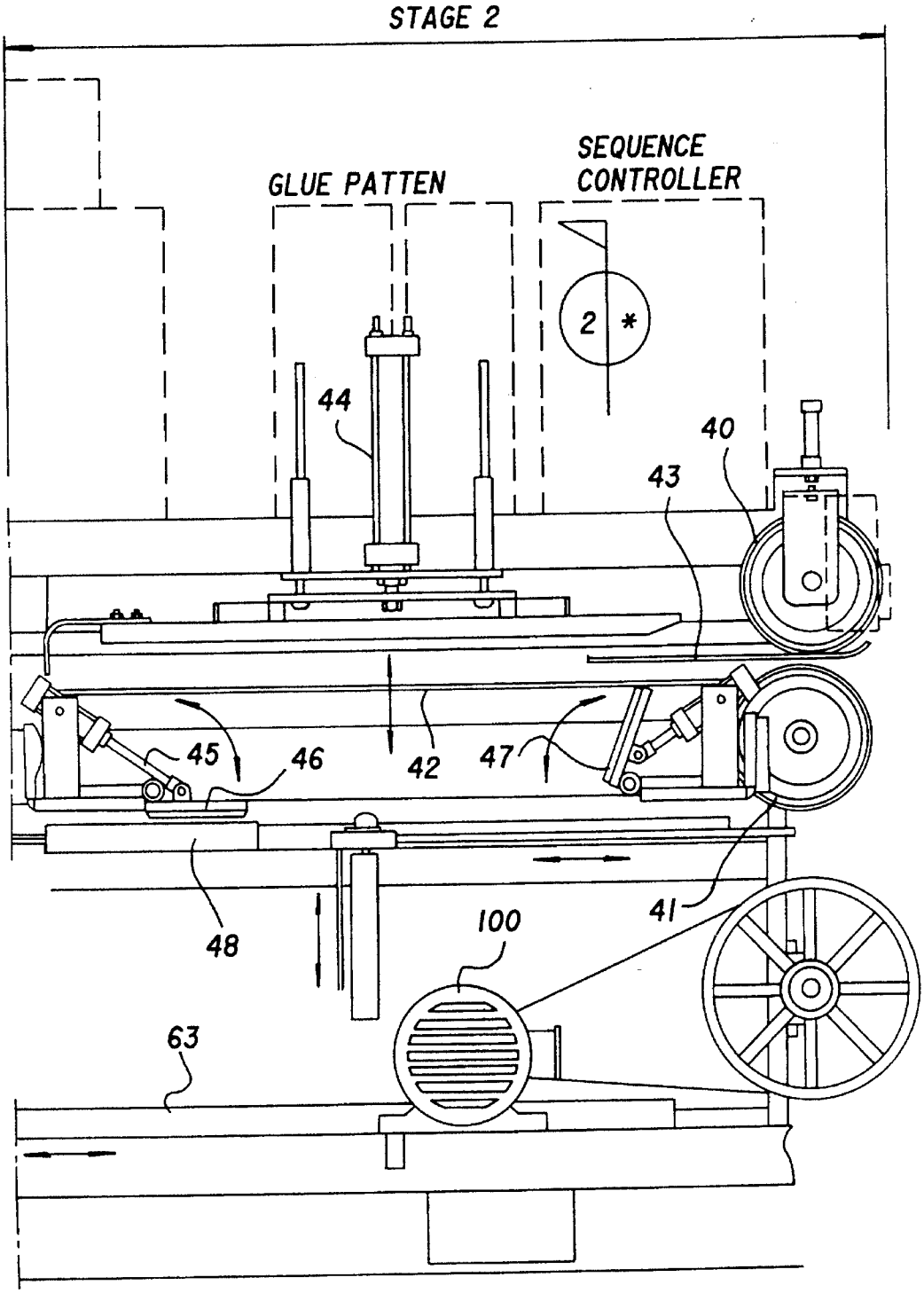
Figure 10C:
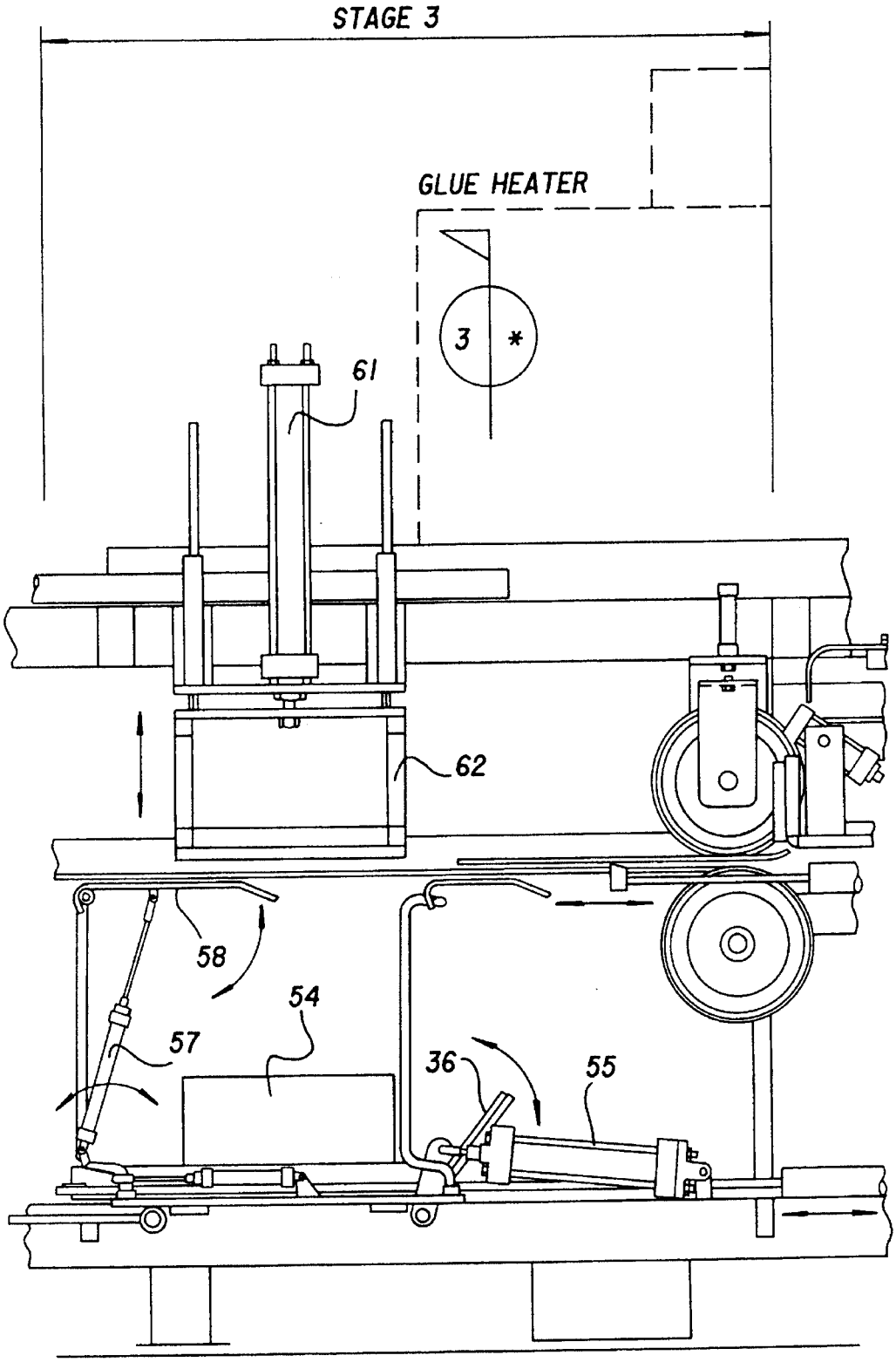
Figure 10D:
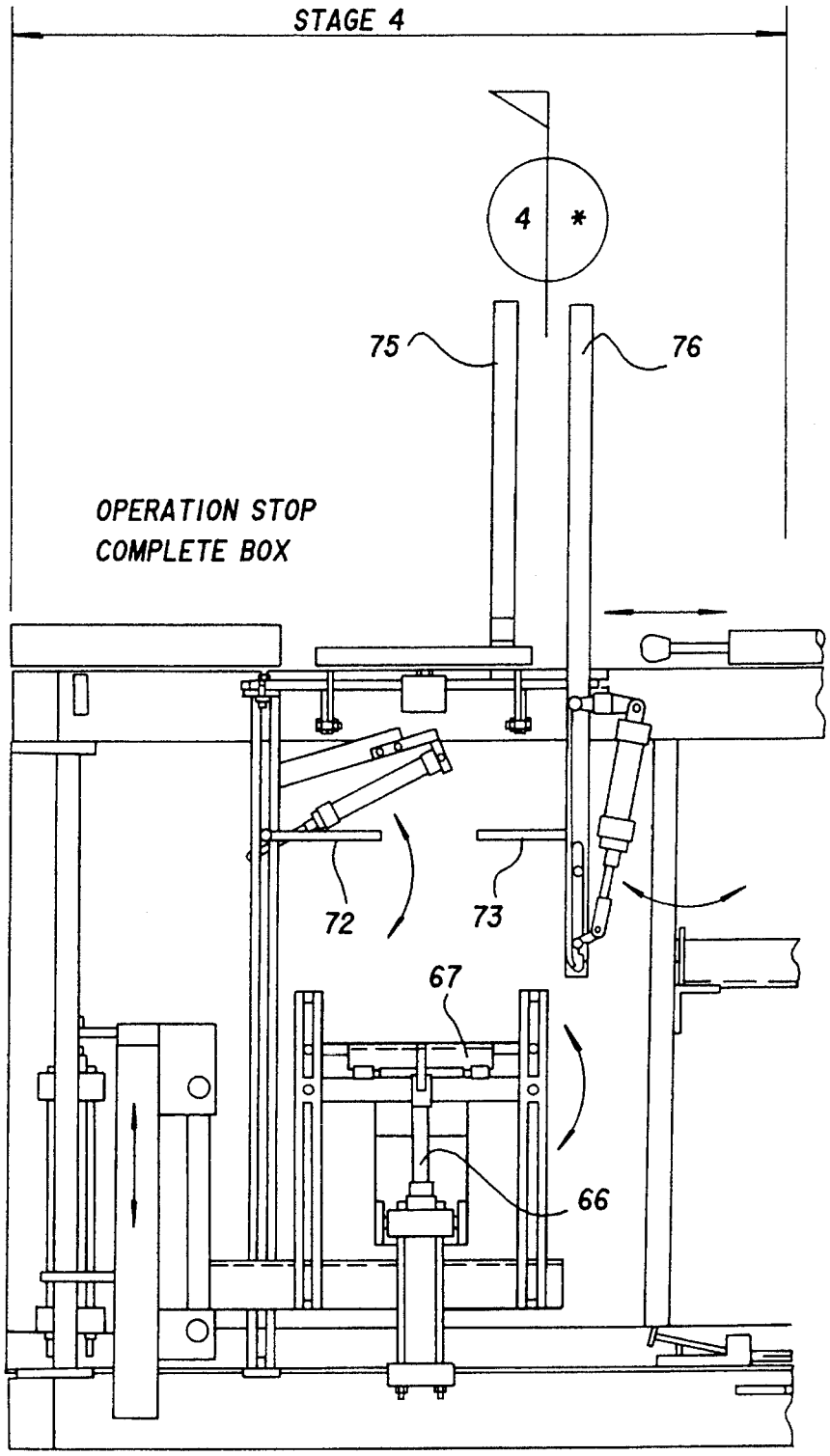
Figure 11A:
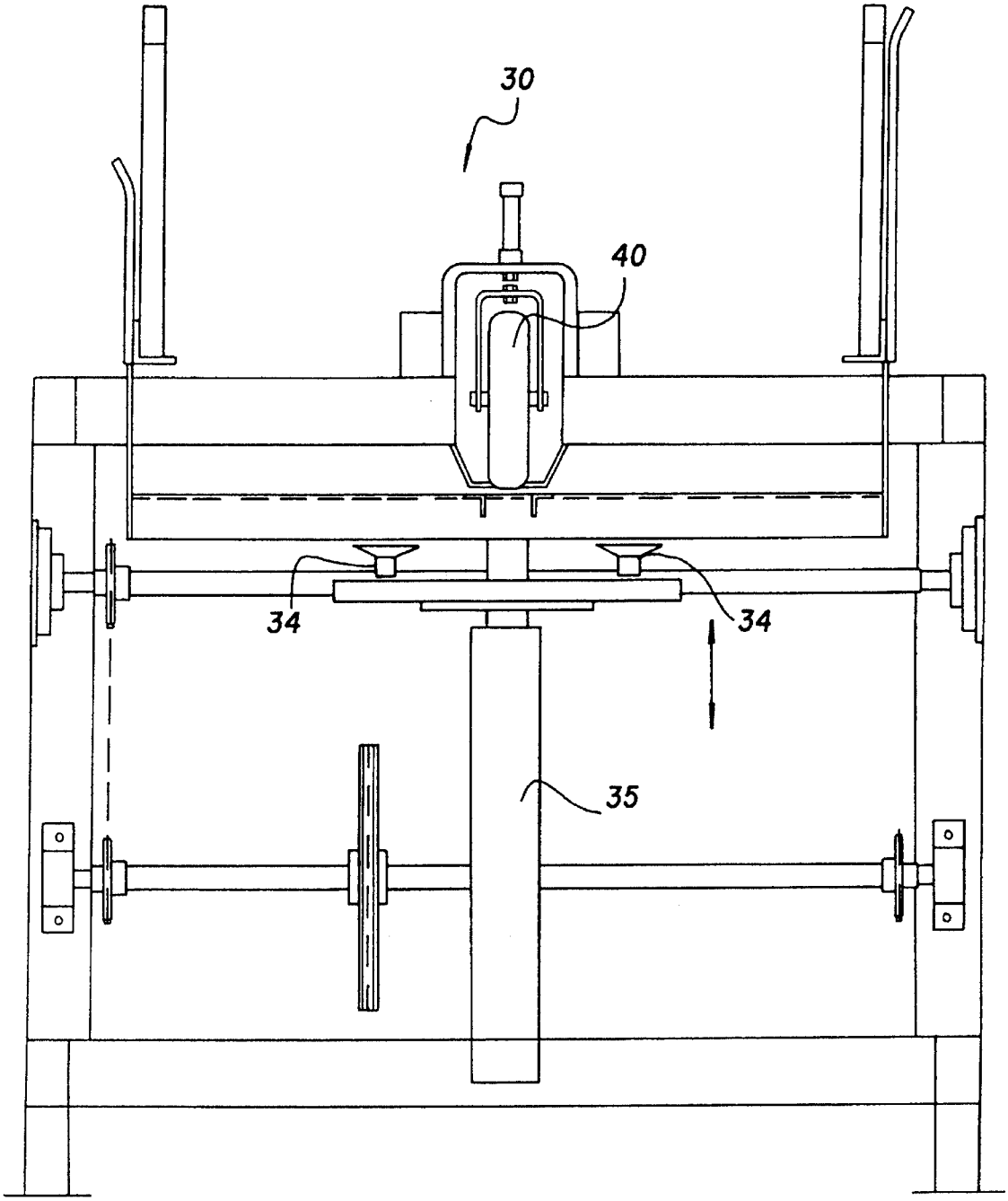
FIGS. 11*a* to 11*d* show the sectional views as located in FIG. 9 and FIG. 10.
Figure 11B:
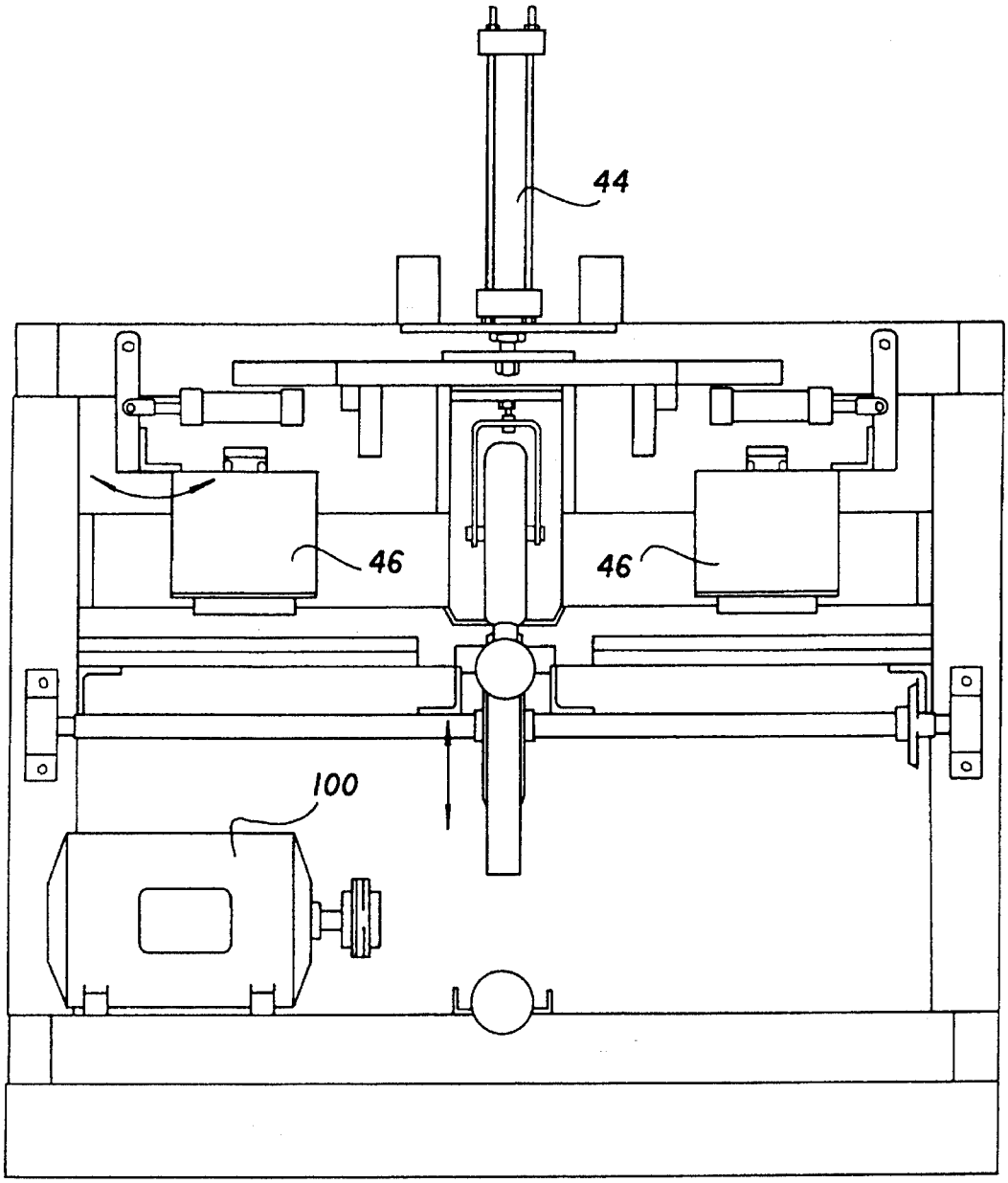
Figure 11C:
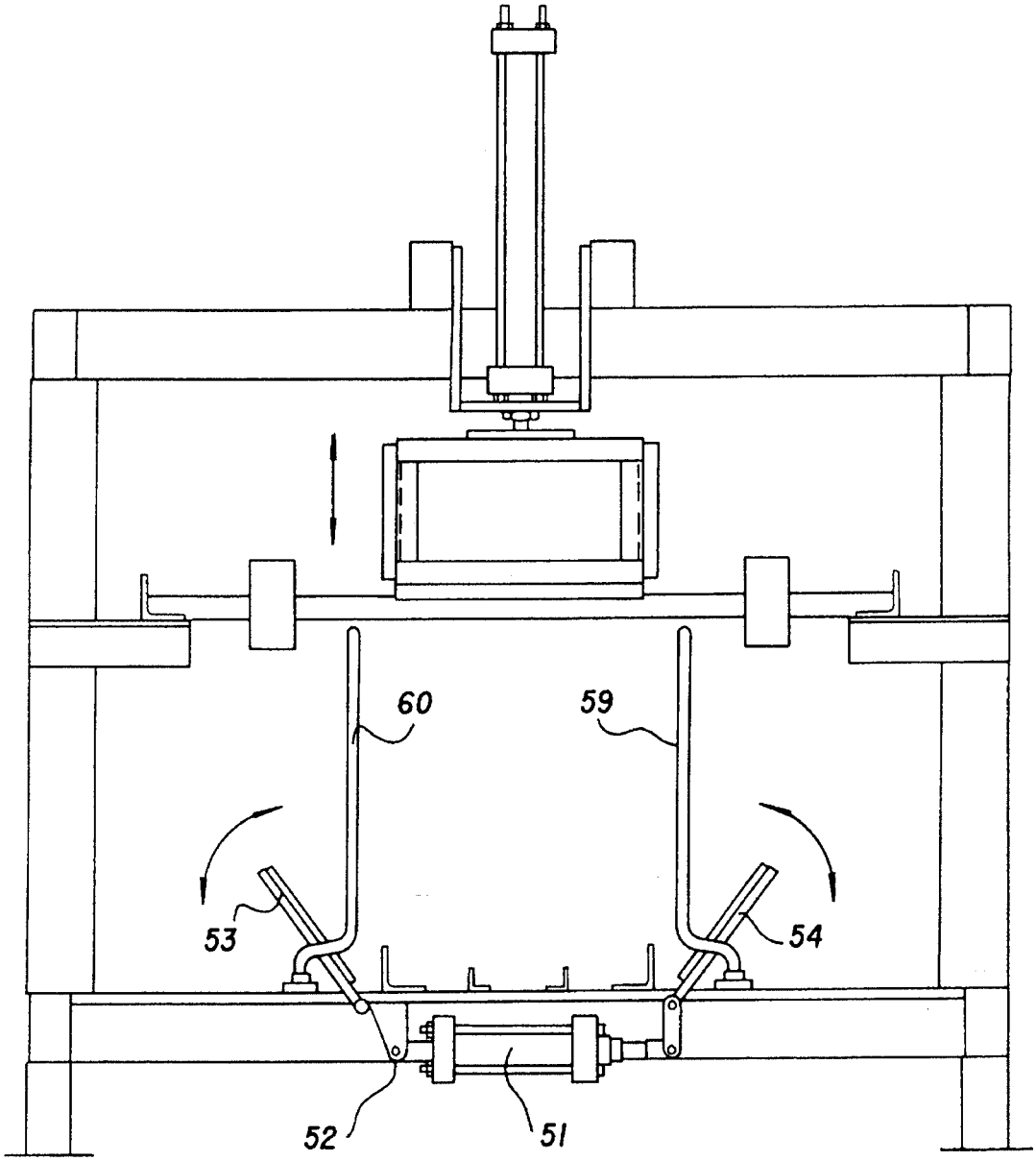
Figure 11D:
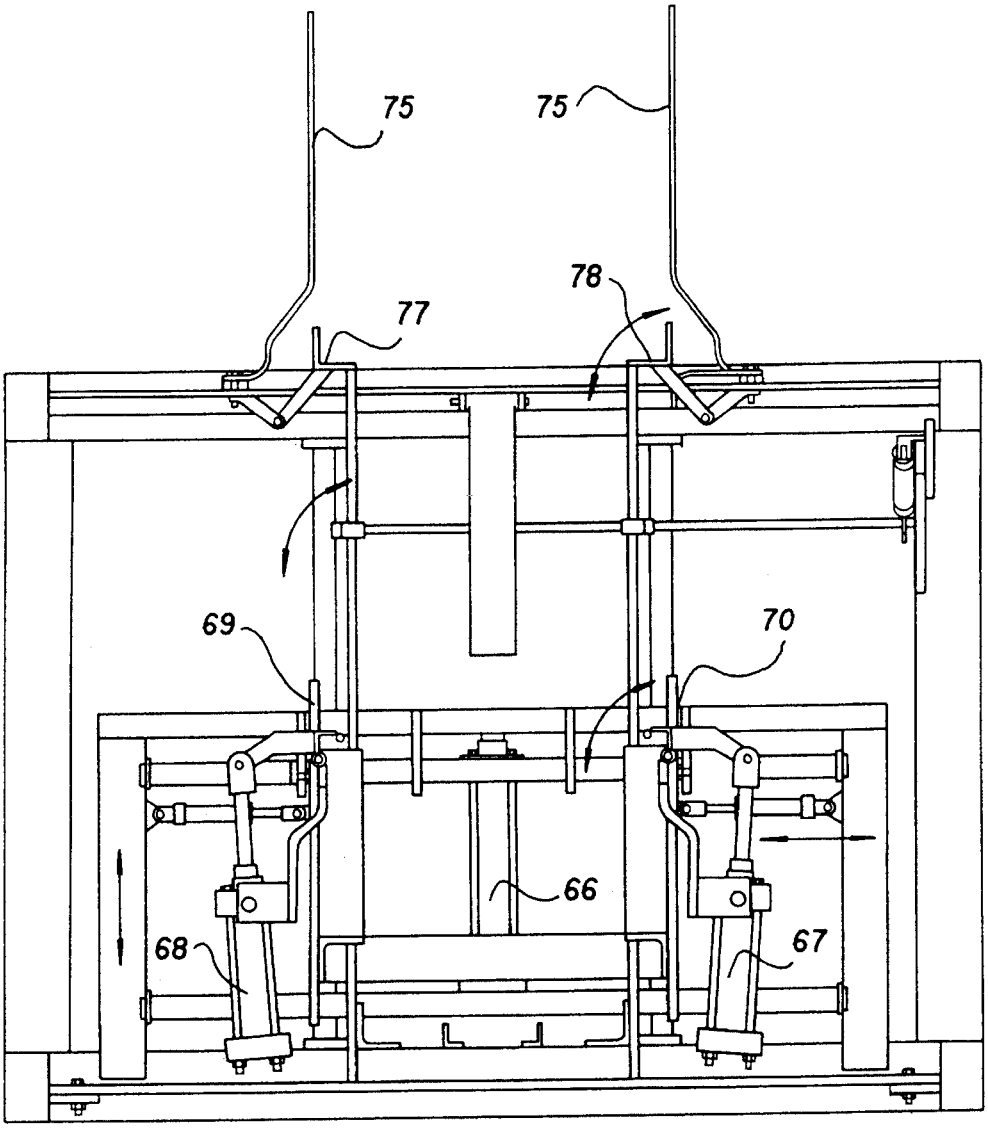

The embodiment of FIGS. 1 and 2 shows a package according to one preferred embodiment of the invention having relatively deep internal dimensions. FIG. 3 shows a blank suitable for forming a slightly shallower tray. FIGS. 4 to 6 show the partly assembled package as shown in FIG. 7 providing yet another preferred form of the invention providing a slightly shallower tray to that of FIG. 1.

The package as shown in FIG. 1 has a base 1 and four side walls 2. At least one pair of support members 3 are provided adjacent an opposing pair of side walls 2. In the embodiments shown, the support members 3 conveniently each consist of a pair of support components 4 which are positioned against an opposing pair of side walls 2.

The support members 3 have at least one tongue and desirably two tongues 5 and corresponding recesses 6. The tongues 5 are positionable in the recesses 6 in use.

Accordingly, the support members 3 are of a type such that when a stack of packages are formed, the tongues 5 are positioned in the recesses 6 of an adjacent package thereby providing mechanical stability to the stack. Also, the weight of the packages in a stack is substantially carried by the support members 3 which are also provided in a stack. This reduces pressure on the articles contained within the package which is desirable when fruit, for example, are contained therein.

It is desirable that the tongues 5 are provided on the upper surface of the support members 3 and the recesses 6 are provided on the underside of the support members 3. Of course, in this embodiment of FIG. 1 an aperture 7 through the base 1 of the package must be provided which corresponds to the recess 6 so that the tongue 5 can be positioned therethrough.

In the preferred embodiment of the invention, at least two opposite parts 20 of the side walls 2 against which the support members 3 are positioned, are foldable into the form of a hollow member and the support member 3 is provided substantially within the hollow member. For example, the upper edge of the side walls 3 can be folded over to form the hollow member. One or more apertures 9 are provided in the hollow member and the tongue or tongues 5 of the support member 3 are positioned therethrough in use.

The package may also have a lid as required. For example, this may be in the form of two lid components 8 which can be folded over the package. The lid components 8 desirably have apertures 9 so that the tongues 5 can be positioned therethrough in use.

The support members 3 are integrally formed in the blank. This is shown in more detail in FIG. 2 and FIG. 3.

FIG. 2 shows a corrugated board blank suitable for use in forming a fairly deep package. For example the depth of the package may be around 18 cm. The embodiment of FIG. 3 provides a shallower package which may for example have a depth of substantially 12 cm.

The method of constructing the package shown in FIG. 1 from the blank of FIG. 2 shall now be described. An area of low cost, hot melt adhesive is applied by a suitable applicator (such as a roller applicator, spray applicator or the like) across the support components 4 and the end wall 2 between the supports 4. The support components 4 can then be formed by folding the two support panels 10 onto each other at fold line 11 thus forming the support components 4.

The side walls 2 are formed by folding the side walls 2 upwardly from the base 1 at fold lines indicated by dotted lines numbered 12. By folding the support components 4 approximately 90° inwardly from the side walls 2 they can be adhered to the inside surface of the adjacent side walls 2. Then, the hollow member in which the support members 3 are positioned can be formed by folding over the upper edge of the opposite parts 20 of the side walls 2. The support components 4 can be positioned in the hollow members thus formed such that the tongues 5 extend through the apertures 9. The support members 3 may be adhered to the inside edge of the hollow member.

Finally, the lid can be formed by folding over the lid components 8 at the dotted fold lines 14.

The construction of the package from the blank of FIG. 3 is substantially the same as that for FIG. 2 save that the support components 4 are folded differently and includes cuts or cut-outs which form the tongues 5, formed along the fold line, and recesses 6. In the resultant package formed from the blank of FIG. 3, the support components 4 meet together. In forming the package from the blank of FIG. 3, a strip of hot melt adhesive is applied by rollers or spray apparatus across the panels 16 and the end wall 2 between them. The panels 16 are then folded at fold line 17 and adhered together so as to form the support components 4. Once the side walls 2 have been formed by folding, the panel components 4 are folded inwardly at about 90° thereto and adhered to the adjacent end walls 2.

In the embodiments of FIGS. 2 and 3 the corrugations of the board run transversely from A to B as shown in the representations and the package is rectangular. This is advantageous over the prior art constructions. This feature reduces sagging of the base 1 of the package.

Thus it can be seen that in at least the preferred form of the invention, a package and/or a blank for forming the package are provided which have several advantages over the art. The package is formed completely from corrugated board so as to be fully recyclable and this is desirable for environmental reasons. Prior art constructions with supports have wooden or moulded plastic support members.

The construction of the package is simplified in that the support members can be formed from the same material as the rest of the package. Furthermore, as the support members are integrally formed in the blank, this reduces wastage of the corrugated board which is obviously desirable. Furthermore, the construction of the box is simplified in that only two continuous bands of adhesive pattern needs to be applied in order to form the support members and adhere them to the side walls.

The apparatus of the present invention operates in a manner as described with reference to FIGS. 4 though 8 inclusive.

Preferably the blanks as depicted in FIGS. 1 and 2 are presented into a magazine and from there they are serially positioned one at a time within the downstream stages or operating zones of the apparatus going from Stage 1 though Stage 4 as depicted. Throughout such presentation no central former is utilized. Instead the base portion (preferably a square or rectangular form) is advanced without any substantial rotation.

Preferably the advancement from operating zone to operating zone is such that a maximum if not all of the adhesive requirements can be applied from above during Stage 1 such that thereafter a sequence of downwardly descending mandrels can be used in relation to appropriate depressions and/or variable forming elements such as upwardly directed flaps and the like adapted to provide the required folds.

Preferably movement from operating zone to operating zone is by means of advancing wheels and/or other conveying means preferably in some other forms suction cups and the like can be utilised.

An embodiment of the invention consisting of an apparatus for forming a carton or package will now be described with reference to FIGS. 9 to 13.

The entire manufacturing operation is divided into four stages. The operation starts with the input of one or more flat blanks at Stage 1 of the operation. The operation finishes at Stage 4 with the output of one or more formed boxes.

At Stage 1 the operation begins with the loading of one or more flat blanks into magazine 30. Magazine 30 consists of substantially upright guide members 31 and 32. The guide members present the bottom most blank in a flat condition. The bottom most blank is selected and removed from the magazine by operation of blank selector 33. The blank selector operates through the expansion of actuator 35 towards its fully expanded condition. This brings holding devices 34 into contact with the bottom most blank. These holding devices grip or hold the blank and when actuator 35 contracts the blank is moved with it. The vertical position only of the blank is changed by the action of the blank selector — all other orientations remain the same. The blank is removed from the holding device by abutment of the blank against the removal devices 36. The holding device continues downward while the blank is prevented from continuing downward by the action of 36 which flees the blank from the grip of the holding device 34. The contraction of actuator 37 brings abutment device 38 into contact with the rearward edge of the selected blank.

The blank is thus moved from Stage 1 forward into Stage 2 through the glue station. Abutment device 38 moves the blank forward until it is gripped between rollers 40 and 41. These rollers pull the blank past glue applicators 39. Glue applicators 39 apply an area of suitable hot melt adhesive to at least the support component 4 and the end wall 2 between supports 4 of the blank. The action of rollers 40 and 41 draws the blank into Stage 2 of the operation. Stage 1 of the manufacturing operation is illustrated by FIG. 13*a*.

Once in Stage 2 the blank is held in position by guides 42 and 43. Actuator 44 is at, or towards, the top most limit of its range of movement. Actuators 44 and 45 are at, or towards, the uppermost limit of their range of movement thus causing edge folders 46 and 47 to be at, or towards, their most upright position. Actuator 44 is then advanced towards the down most position of its range thus pushing down pattern former 47 which contacts with the blank and moves it downwards. The abutment of the blank with edge folders 46 and 47 causes the rearmost and front most edges 20 of the blank to fold up towards a vertical position. Actuators 44 and 45 are then advanced towards the outermost portion of their range thus moving edge folders 47 and 46 towards a horizontal position and thus folding the rearmost and front most edge of the blank back towards the main body of the blank. Actuator 44 then begins to move up towards the topmost portion of its range thus moving 47 up away from the blank. Actuators 45 and 46 begin to contract thus releasing edge folders 46 and 47 from the surface of the folded edge. The contraction of actuator 48 moves the edge folded blank into rollers 49 and 50. Stage 2 of the manufacturing operation is illustrated by FIG. 13*b*. The edge folded blank is, therefore, drawn into Stage 3 of the operation.

When the folded blank enters Stage 3 actuator 61 is at, or towards, the topmost portion of its range thus pattern 62 is at, or towards, the topmost portion of its range. Actuator 61 then moves towards the bottom portion of its range thus moving pattern 62 downwards. The pattern contacts with the blank pushing it down. The blank abuts against guides 60 and 59 which fold up flaps 16. Actuators 51 and 52 then begin to expand thus bringing edge folders 53 and 54 up towards a vertical position. This has the effect of folding up flap 20 of the blank which form the sides. At or about the same time, actuator 55 expands thus bringing edge former 56 up, or towards, a vertical position. This has the effect of folding up flap 8 of the blank. At or about the same time edge former 65 is moved up towards the vertical position. This has the effect of folding up the front most flap 8 of the blank. At the end of this sequence which is also illustrated by FIG. 13*c* the box has four folded up sides. Actuator 55 and the actuator controller 65 begin to contract thus bringing edge folder 56 and edge folder 65 down towards the horizontal position. Actuators 51 and 52 also begin to contract thus bringing edge folders 53 and 54 away from the box sides. When actuator 65 is fully horizontal, actuator 63 begins to expand thus forcing forward abutment device 64. This has the effect of forcing the box out of Stage 3 and into the final stage of the operation, Stage 4. Stage 3 of the manufacturing operation is illustrated by FIG. 13*c*.

At the start of Stage 4 actuator 66 is at the bottom most portion of its range, thus box holder 67 is at the bottom most portion of its range. Actuators 67 and 68 are at the contracted state thus edge folders 69 and 70 are vertical. Actuator 66 then begins to move upwards thus moving upwards box holder 67. Actuator 67 and 68 then begin to expand thereby moving edge folders 69 and 70 toward the horizontal portion of their range. This has the effect of folding over edge 20 of the box. Actuators 67 and 68 then contract thus releasing edge folders 69 and 70 from gripping the box. Actuator 71 and the actuator controlling edge folder 73 are initially contracted. They begin to expand thus forcing towards the horizontal position edge folders 72 and 73. This has the effect of folding over and closing the lid of the box. Actuator 71 and the actuator controlling flap folder 73 then begin to contract thus moving edge folder 72 and edge folder 73 away from the lid of the box. The box continues to move upwards. When the Lox is at the top of its range, box holders 77 and 78 move forward and hold the box. Actuator 66 then begins to descend. The box is thus held by box holders 77 and 78 and between guides 75 and 76. Completed boxes are thus added to the completed box stack from the bottom. When a preselected number of boxes are contained within the stack, actuator 79 begins to expand thus forcing forward abutment device 80. The completed stack of boxes is, therefore, ejected from Stage 4 out of the apparatus.

Persons skilled in the art will appreciate how a substantially planar blank can be serially moved into the other operating zones of a machine and be progressed through a sequence of the different stage forming stations to emerge in its final completed form utilising a miscellany of controls and forming mandrels, flaps etc.

In the preferred form of the present invention, such as, for example shown in the accompanying drawings, there are differences from the blank and related methods disclosed in U.S. Pat. No. 4,134,533 and also some advantages thereover. These include:

(i) the prior art construction as shown in FIG. 15 takes a section of the material inwardly of the corners but at the ends in which to define the vertically extending corrugated sections to be included in the end walls whereas the blank and related method of the present invention takes such vertically extending corrugated board members that are to reinforce the end walls from extensions of the side walls such that there is a taking of material from a blank of overall lesser dimensions from adjacent the corners thereof;

(ii) as best depicted by reference to FIGS. 17 and 18, the lid sections of a package or carton in accordance with the present invention are taken from the side walls rather than the end walls as in U.S. Pat. No. 4,134,533;

(iii) in the constructions in accordance with the present invention, the side walls are of a single thickness of corrugated board only but appropriately strengthened by the flaps being folded inwardly therefrom and the engagement in use with the lid structures. Such a single thickness assists in the pre-cooling as only the end panels have multiple layers of corrugated board;

(iv) the construction of the present invention makes better use of corrugated board;

(v) the internal packing dimension can be maximised for a given amount of board;

(vi) there is an ability to minimise tray compression by recessing lid closure into the end wall;

(vii) all four walls of a package of the present invention have vertically extending corrugations whereas in the side walls of the package or carton of U.S. Pat. No. 4,134,533 the side walls have horizontally extending corrugations that does have a lesser load carrying capacity when the cartons are stacked one on top of another and which, additionally, have a decreased resistance to damage.

The present, therefore, provides a carton capable of ready assembly by the method of the present invention using the apparatus of the present invention, while at the same time providing for a more economic container that maximises storage space while conferring additional advantages.

The present invention consists in the sequence of forming a package, apparatus suitable for such sequencing of forming and of course the package itself including filled forms of the package.

I claim:

1. A blank for a carton or package, said package comprising:

a rectangular base portion limited by fold lines and said base portion having openings formed therein; and four separate peripheral portions including (i) an opposed pair of the peripheral portions being foldable to create first opposed side walls and subsequent to assembly being further folded to provide at least part of a top of the package, portions of the peripheral portions to form said first opposed side walls being extended at one end in a direction parallel to the fold line connection to the base portion to define a flap which can be folded at right angles from the side wall to assume a position as part of the structure of an end wall normal to each first opposed side wall with at least one projection formed by part of said flap directed upwardly and said flap further containing a single fold line defining two equal sized support panels, said two equal sized support panels folded onto each other at said fold line to provide an entire area of said flap with a double thickness of material and wherein said single fold line extending only across an entire width of said two support panels and a cut-out along said single fold line defining said at least one projection of said flap; and (ii) a second opposed pair of peripheral portions each being foldable to create a remaining part of the structure of said end wall normal to said first opposed side walls;

wherein parallel flutes of corrugated board run across the blank to be a) vertically extending in each side wall and b) vertically extending in at least that part of each said flap having said at least one projection when the blank is assembled and wherein said openings formed in the base portion allow nestings therein of projections of a similar package positioned therebeneath to provide a nesting capability.

2. A blank as claimed in claim 1 wherein said second opposed pair of peripheral portions when folded up to define part of the structure of said end wall can then be folded over said flap with said projection or projections thereof protruding through an opening in said second opposed pair of peripheral portions.

3. A blank as claimed in claim 1 wherein said base portion is rectangular and the foldline of each side wall is a longer periphery of the base portion.

4. A blank as claimed in claim 1 wherein each end wall, when assembled, includes at least two projections each defined in one thickness of the corrugated board from said double thickness of material, each projection being defined from a different said flap of different side walls.

5. A blank as claimed in claim 1 wherein when assembled said flaps forming part of the structure of the same end wall are separated from one another.

6. A blank as claimed in claim 1 wherein said single fold line defining said two support panels is in a direction parallel to the fold line connection to the base portion.

7. A blank as claimed in claim 1 wherein a recess is provided along said one edge of one of said panels opposite from the edge of said one panel forming said single fold line between said two support panels.

8. A blank as claimed in claim 7 wherein said panels have a second recess the respective recesses of said two support panels being aligned to correspond in position when said two support panels are folded on each other and together correspond in position to a respective one of said openings in said base portion when said flap is folded at right angles.

9. A blank as claimed in claim 1 wherein the rectangular base portion is square.

10. A blank according to claim 1 wherein said rectangular base portion is non-square.

11. A package formed from a blank comprising:

a rectangular base portion limited by fold lines and said base portion having openings formed therein; and four separate peripheral portions including (i) an opposed pair of the peripheral portions being foldable to create first opposed side walls and subsequent to assembly being further folded to provide at least part of a top of the package, portions of the peripheral portions to form said first opposed side walls being extended at one end in a direction parallel to the fold line connection to the base portion to define a flap which can be folded at right angles from the side wall to assume a position as part of the structure of an end wall normal to each first opposed side wall with at least one projection formed by part of said flap directed upwardly and said flaps further containing a single fold line defining two equal sized support panels, said single fold line extending only across an entire width of said two equal sized support panels, said two equal sized support panels folded onto each other at said single fold line to provide an entire area of said flap with a double thickness of material, and a cut-out along said single fold line defining said at least one projection of said flap; and (ii) a second opposed pair of peripheral portions each being foldable to create a remaining part of the structure of said end wall normal to said first opposed side walls;

wherein in the assembled package parallel flutes of corrugated board run across the blank to be a) vertically extending in each side wall and b) vertically extending in at least that part of each said flap having said at least one projection and wherein said openings formed in the base portion allow nesting therein of projections of a similar package positioned therebeneath to provide a nesting capability.

12. A package as claimed in claim 4 wherein said second opposed pair of peripheral portions when folded up to form part of the structure of said end wall can then be folded over said flap with said at least one projection or projections of the flap protruding through an opening in said second opposed pair of peripheral portions.

13. A package as claimed in claim 11 or claim 12 wherein said base portion is rectangular and the foldline of each side wall is a longer periphery of the base portion.

14. A package as claimed in claim 11 wherein each end wall in the package includes at least two said projections each defined in one thickness of the corrugated board from said double thickness of material, each projection being defined from a different said flap of different side walls.

15. A package as claimed in claim 11 wherein said flaps forming part of the structure of the same end wall do not overlie one another.

16. A package of claim 11 wherein said flaps are adhered to said second peripheral portions.

17. A package of claim 11 wherein said first opposed pair of peripheral portions have openings therein to locate over respective projections when said first opposed pair of peripheral portions are folded over to provide at least part of said top of said package.

18. A package as claimed in claim 11 wherein the rectangular base portion is square.

19. A package according to claim 11 wherein said rectangular base portion is non-square.

* * * * *